US005853043A

United States Patent [19]

Takeuchi et al.

[11] Patent Number: 5,853,043

[45] Date of Patent: Dec. 29, 1998

[54] METHOD AND APPARATUS FOR CONTINUOUS CASTING OF A THIN SLAB

[75] Inventors: Isamu Takeuchi, Nishinomiya; Akihiro Yamanaka, Osaka; Kazuo Okamura, Nishinomiya; Hiroyasu Simizu, Kobe; Takasi Kanazawa; Seiji Kumakura, both of Kashima; Masakazu Koide, Narashino; Toshihiko Murakami; Tadao Watanabe, both of Kashima, all of Japan

[73] Assignee: Sumitomo Metal Industries, Ltd., Osaka, Japan

[21] Appl. No.: 591,536

[22] PCT Filed: Jul. 27, 1995

[86] PCT No.: PCT/JP95/01504

§ 371 Date: Feb. 6, 1996

§ 102(e) Date: Feb. 6, 1996

[87] PCT Pub. No.: WO96/04086

PCT Pub. Date: Feb. 15, 1996

[30] Foreign Application Priority Data

Jul. 29, 1994 [JP] Japan ..... 6-178448
Jul. 12, 1995 [JP] Japan ..... 7-175885

[51] Int. Cl.[6] ..... B22D 11/12; B21B 1/46

[52] U.S. Cl. ..... 164/476; 164/417; 164/424; 164/452

[58] Field of Search ..... 164/476, 452, 164/417, 424

[56] References Cited

U.S. PATENT DOCUMENTS

| | | | |
|---|---|---|---|
| 4,043,382 | 8/1977 | Saito et al. | 164/476 |
| 5,488,987 | 2/1996 | DiGiusto et al. | 164/452 |

FOREIGN PATENT DOCUMENTS

| | | | |
|---|---|---|---|
| 5-69088 | 3/1933 | Japan | 164/476 |
| 62-28056 | 2/1987 | Japan | 164/476 |
| 63-60051 | 3/1988 | Japan . | |
| 63-242452 | 10/1988 | Japan | 164/452 |
| 63-286260 | 11/1988 | Japan | 164/476 |
| 64-15647 | 1/1989 | Japan . | |
| 64-49350 | 3/1989 | Japan . | |
| 2-20650 | 1/1990 | Japan . | |
| 2-52159 | 2/1990 | Japan . | |
| 3-124352 | 5/1991 | Japan . | |
| 4-33757 | 2/1992 | Japan | 164/476 |
| 5-15956 | 1/1993 | Japan | 164/476 |
| 6-63715 | 3/1994 | Japan | 164/476 |

OTHER PUBLICATIONS

New Evaluation of Critical Strain for Internal Crack Formation in Continuous Casting, A. Yamanaka et al., ATS Steelmaking Conference (1991), pp. 627–633.

Measurement of Critical Strain for Solidification Cracking, A. Yamanaka, et al., The Minerals, Metals & Materials Society (1991), pp. 279–284.

*Primary Examiner*—J. Reed Batten, Jr.

*Attorney, Agent, or Firm*—Burns, Doane, Swecker & Mathis, LLP

[57] ABSTRACT

A thin slab that is free of internal cracks is formed by reducing a continuously cast strand having a liquid core. The placement of the reduction rolls is controlled to effect a suitable amount of reduction. The methods effectively reduce bulging strain, as well as strain associated with reduction of the strand. As a result, total accumulated strain is reduced and a thin slab free of internal cracks can be manufactured at high speeds. The apparatus includes reduction blocks which are capable of shifting the rotation angle of an upper roller segment frame. Misalignment strain is reduced and the thickness of the strand can be changed without stopping the manufacturing operation.

7 Claims, 21 Drawing Sheets

Fig. 18

| Chemical composition (mass%、bal. : Fe) | | | | | Critical strain (%) |
|---|---|---|---|---|---|
| C | Mn | Si | P | S | |
| 0. 20 | 0. 60 | 0. 08 | 0. 020 | 0. 012 | 0. 90 |

Fig. 19

| Red. roller No. | | Before | 1 | 2 | 3 | 4 | 5 | 6 | 7 | 8 | 9 | 10 | 11 | 12 | 13 | 14 | 15 | After | Evaluation |
|---|---|---|---|---|---|---|---|---|---|---|---|---|---|---|---|---|---|---|---|
| Roller pitch | | – | 185 | 185 | 190 | 190 | 195 | 195 | 200 | 205 | 210 | 210 | 216 | 216 | 222 | 222 | 227 | – | |
| Exam. 1 | (1)* (mm) | 0 | 3.50 | 3.29 | 3.08 | 2.87 | 2.66 | 2.45 | 2.24 | 2.03 | 1.82 | 1.61 | 1.40 | 1.19 | 0.98 | 0.77 | 0.11 | 0 | A |
| | (2)* (mm) | 100 | 96.50 | 93.21 | 90.13 | 87.26 | 84.60 | 82.15 | 79.91 | 77.88 | 76.06 | 74.45 | 73.05 | 71.86 | 70.88 | 70.11 | 70.00 | 70 | |
| | (3)* Rn(%) | 0 | 1.89 | 1.78 | 1.62 | 1.51 | 1.36 | 1.26 | 1.12 | 0.99 | 0.87 | 0.77 | 0.65 | 0.55 | 0.44 | 0.35 | 0.06 | 0 | |
| | (4)* (%) | – | -1.89 | 0.11 | 0.16 | 0.11 | 0.15 | 0.10 | 0.14 | 0.13 | 0.12 | 0.10 | 0.12 | 0.10 | 0.11 | 0.09 | 0.30 | 0.06 – | |
| Exam. 2 | (1)* (mm) | 0 | 3.50 | 3.29 | 3.08 | 2.87 | 2.66 | 2.345 | 2.345 | 2.03 | 1.82 | 1.61 | 1.40 | 1.19 | 0.98 | 0.77 | 0.11 | 0 | A |
| | (2)* (mm) | 100 | 96.50 | 93.21 | 90.13 | 87.26 | 84.60 | 82.255 | 79.91 | 77.88 | 76.06 | 74.45 | 73.05 | 71.86 | 70.88 | 70.11 | 70.00 | 70 | |
| | (3)* Rn(%) | 0 | 1.89 | 1.78 | 1.62 | 1.51 | 1.36 | 1.20 | 1.17 | 0.99 | 0.87 | 0.77 | 0.65 | 0.55 | 0.44 | 0.35 | 0.06 | 0 | |
| | (4)* (%) | – | -1.89 | 0.11 | 0.16 | 0.11 | 0.15 | 0.16 | 0.03 | 0.18 | 0.12 | 0.10 | 0.12 | 0.10 | 0.11 | 0.09 | 0.30 | 0.06 – | |
| Compa. Exam. 1 | (1)* (mm) | 0 | 2 | 2 | 2 | 2 | 2 | 2 | 2 | 2 | 2 | 2 | 2 | 2 | 2 | 2 | 2 | 0 | C |
| | (2)* (mm) | 100 | 98 | 96 | 94 | 92 | 90 | 88 | 86 | 84 | 82 | 80 | 78 | 76 | 74 | 72 | 70 | 70 | |
| | (3)* Rn(%) | 0 | 1.08 | 1.08 | 1.05 | 1.05 | 1.03 | 1.03 | 1.00 | 0.98 | 0.95 | 0.95 | 0.93 | 0.93 | 0.90 | 0.90 | 0.88 | 0 | |
| | (4)* (%) | – | -1.08 | 0 | 0.03 | 0 | 0.02 | 0 | 0.03 | 0.02 | 0.03 | 0 | 0.02 | 0 | 0.03 | 0 | 0.02 | 0.88 – | |
| Compa. Exam. 2 | (1)* (mm) | 0 | 0.11 | 0.77 | 0.98 | 1.19 | 1.40 | 1.61 | 1.82 | 2.03 | 2.24 | 2.45 | 2.66 | 2.87 | 3.08 | 3.29 | 3.50 | 0 | C |
| | (2)* (mm) | 100 | 99.89 | 99.12 | 98.14 | 96.95 | 95.55 | 93.94 | 92.12 | 90.09 | 87.85 | 85.40 | 82.74 | 79.87 | 76.79 | 73.50 | 70.00 | 70 | |
| | (3)* Rn(%) | 0 | 0.06 | 0.42 | 0.52 | 0.63 | 0.72 | 0.83 | 0.91 | 0.99 | 1.07 | 1.17 | 1.23 | 1.33 | 1.39 | 1.48 | 1.54 | 0 | |
| | (4)* (%) | – | -0.06 | -0.36 | -0.10 | -0.11 | -0.11 | -0.11 | -0.08 | -0.08 | -0.08 | -0.10 | -0.06 | -0.10 | -0.06 | -0.09 | -0.06 | 1.54 – | |

(Notes) (1)* : Reduction amount, (2)* : Slab thickness,
(3)* : Reduction incline, (4)* : Difference in the reduction incline
red. : Reduction, Exam. : Example, Compa. : Comparative L : Metallurgical machine length

Fig. 21

| Reduction block | | Before | No. 1 Reduction block | | | | | No. 2 Reduction block | | | | | No. 3 Reduction block | | | | | After | | Evaluation |
|---|---|---|---|---|---|---|---|---|---|---|---|---|---|---|---|---|---|---|---|---|
| Reduction roller No. | | – | 1 | 2 | 3 | 4 | 5 | 6 | 7 | 8 | 9 | 10 | 11 | 12 | 13 | 14 | 15 | – | | |
| Roller pitch (mm) | | – | 185 | 185 | 190 | 190 | 195 | 195 | 200 | 205 | 210 | 210 | 216 | 216 | 222 | 222 | 227 | – | | |
| Exam. 3 | (1)* (mm) | 0 | 3 | 3 | 3 | 3 | 3 | 2 | 2 | 2 | 2 | 2 | 1 | 1 | 1 | 1 | 1 | 0 | | A |
| | (2)* (mm) | 100 | 97 | 94 | 91 | 88 | 85 | 83 | 81 | 79 | 77 | 75 | 74 | 73 | 72 | 71 | 70 | 70 | | |
| | (3)* Ri(%) | 0 | 1.59 | | | | | 0.98 | | | | | 0.45 | | | | | 0 | | |
| | (4)* (%) | – | – | | | | 0.61 | – | | | | 0.53 | – | | | | 0.45 | | – | |
| Exam. 4 | (1)* (mm) | 0 | 3 | 3 | 3 | 3 | 3 | 1.5 | 1.5 | 1.5 | 1.5 | 1.5 | 1.5 | 1.5 | 1.5 | 1.5 | 1.5 | 0 | | A |
| | (2)* (mm) | 100 | 97 | 94 | 91 | 88 | 85 | 83.5 | 82 | 80.5 | 79 | 77.5 | 76 | 74.5 | 73 | 71.5 | 70 | 70 | | |
| | (3)* Ri(%) | 0 | 1.59 | | | | | 0.74 | | | | | 0.68 | | | | | 0 | | |
| | (4)* (%) | – | – | | | | 0.85 | – | | | | 0.06 | – | | | | 0.68 | | – | |
| Exam. 5 | (1)* (mm) | 0 | 5 | 5 | 5 | 5 | 5 | 1 | 1 | 1 | 1 | 1 | 0 | 0 | 0 | 0 | 0 | 0 | | B |
| | (2)* (mm) | 100 | 95 | 90 | 85 | 80 | 75 | 74 | 73 | 72 | 71 | 70 | 70 | 70 | 70 | 70 | 70 | 70 | | |
| | (3)* Ri(%) | 0 | 2.65 | | | | | 0.49 | | | | | 0 | | | | | 0 | | |
| | (4)* (%) | – | – | | | | 2.16 | – | | | | 0.49 | – | | | | 0 | | – | |
| Compa. Exam. 3 | (1)* (mm) | 0 | 2 | 2 | 2 | 2 | 2 | 2 | 2 | 2 | 2 | 2 | 2 | 2 | 2 | 2 | 2 | 0 | | C |
| | (2)* (mm) | 100 | 98 | 96 | 94 | 92 | 90 | 88 | 86 | 84 | 82 | 80 | 78 | 76 | 74 | 72 | 70 | 70 | | |
| | (3)* Ri(%) | 0 | 1.06 | | | | | 0.98 | | | | | 0.91 | | | | | 0 | | |
| | (4)* (%) | – | – | | | | 0.08 | – | | | | 0.07 | – | | | | 0.91 | | – | |

(Notes) (1)* : Reduction amount, (2)* : Slab thickness,
(3)* : Mean reduction incline, (4)* : Difference in the mean reduction incline,
Exam. : Example, Compa. : Comparative

Fig. 23

| Apparatus layout | | Bending zone | | | | | | Reduction zone | | | | | | | | | | | | | | | Evaluation |
|---|---|---|---|---|---|---|---|---|---|---|---|---|---|---|---|---|---|---|---|---|---|---|---|
| Roller | No. | 6 | 7 | 8 | 9 | 10 | 11 | 1 | 2 | 3 | 4 | 5 | 6 | 7 | 8 | 9 | 10 | 11 | 12 | 13 | 14 | 15 | |
| Exam. 6 | Red. zone | | | | | | | ——— | ——— | ——— | ——— | ——— | ——— | ——— | ——— | ——— | ——— | ——— | ——— | ——— | ——— | ——— | A |
| | (1)* (mm) | | | | | | | 3.50 | 3.29 | 3.08 | 2.87 | 2.66 | 2.45 | 2.24 | 2.03 | 1.82 | 1.61 | 1.40 | 1.19 | 0.98 | 0.77 | 0.11 | |
| | (2)* (mm) | 100 | 100 | 100 | 100 | 100 | 100 | 96.5 | 93.2 | 90.13 | 87.26 | 84.60 | 82.15 | 79.91 | 77.88 | 76.06 | 74.45 | 73.05 | 71.86 | 70.88 | 70.11 | 70.00 | |
| Exam. 7 | Red. zone | ——— | ——— | ——— | ——— | ——— | ——— | ——— | ——— | ——— | ——— | ——— | ——— | ——— | ——— | ——— | | | | | | | A′ |
| | (1)* (mm) | 3.50 | 3.29 | 3.08 | 2.87 | 2.66 | 2.45 | 2.24 | 2.03 | 1.82 | 1.61 | 1.40 | 1.19 | 0.98 | 0.77 | 0.11 | | | | | | | |
| | (2)* (mm) | 96.5 | 93.2 | 90.13 | 87.26 | 84.60 | 82.15 | 79.91 | 77.88 | 76.06 | 74.45 | 73.05 | 71.86 | 70.88 | 70.11 | 70.00 | | | | | | | |
| Exam. 8 | Red. zone | | | | | | | I | | | | | II | | | | | III | | | | | A |
| | (1)*(mm) | | | | | | | 3 | 3 | 3 | 3 | 3 | 2 | 2 | 2 | 2 | 2 | 1 | 1 | 1 | 1 | 1 | |
| | (2)*(mm) | 100 | 100 | 100 | 100 | 100 | 100 | 97 | 94 | 91 | 88 | 85 | 83 | 81 | 79 | 77 | 75 | 74 | 73 | 72 | 71 | 70 | |
| Exam. 9 | Red. zone | I | | | | | | II | | | | III | | | | | | | | | | | A′ |
| | (1)*(mm) | 3 | 3 | 3 | 3 | 3 | 2 | 2 | 2 | 2 | 2 | 1 | 1 | 1 | 1 | 1 | | | | | | | |
| | (2)*(mm) | 97 | 94 | 91 | 88 | 85 | 83 | 81 | 79 | 77 | 75 | 74 | 73 | 72 | 71 | 70 | 70 | 70 | 70 | 70 | 70 | 70 | |

(Notes) (1)* : Reduction amount, (2)* : Slab thickness,
Exam. : Example, Red. : Reduction

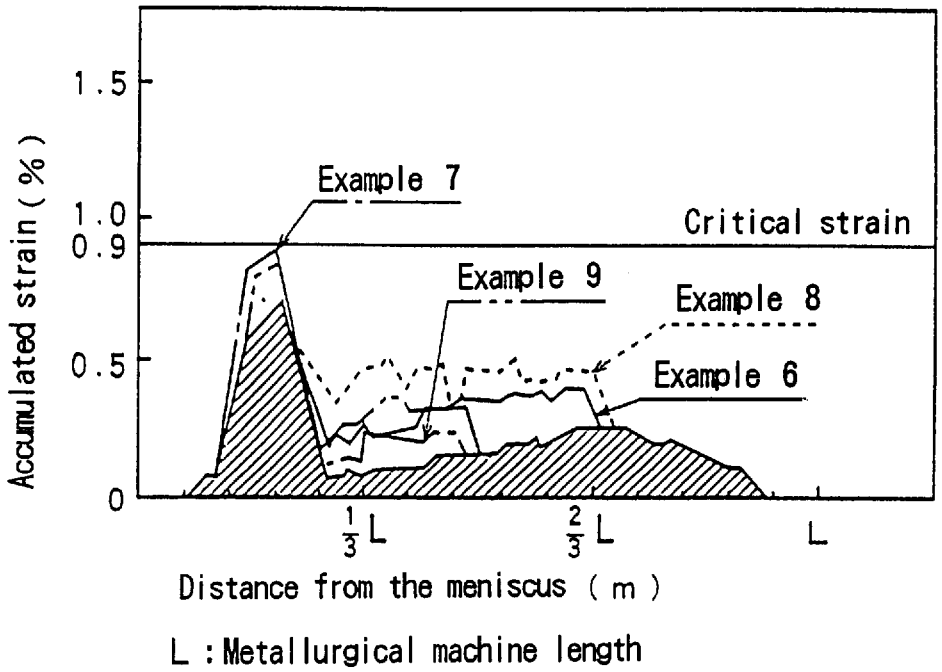
Fig. 25
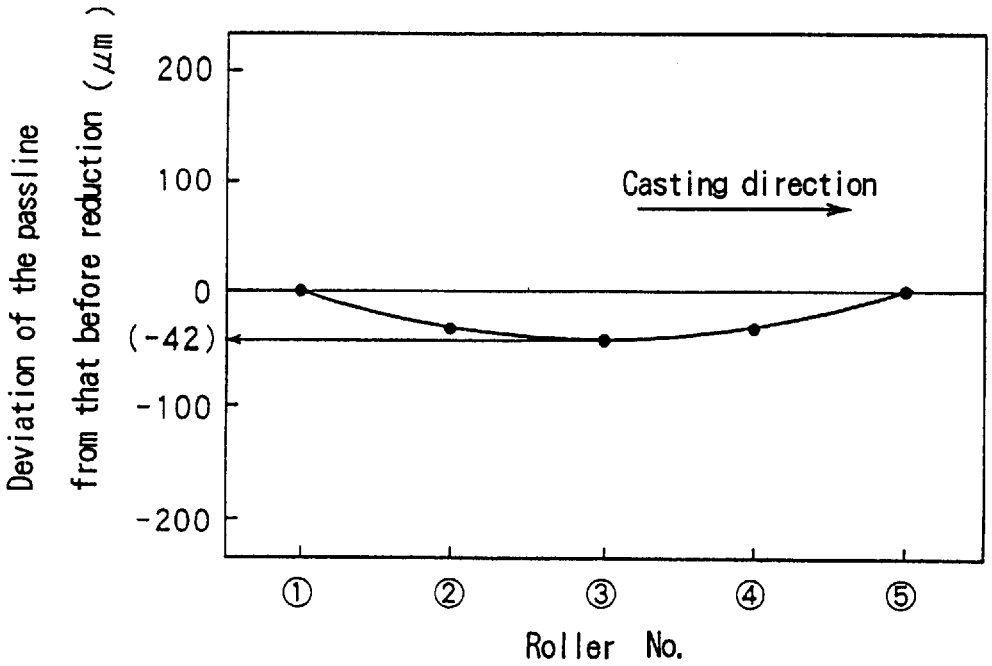

METHOD AND APPARATUS FOR CONTINUOUS CASTING OF A THIN SLAB

BACKGROUND OF THE INVENTION

1. Field of the Invention

The present invention relates to a method and apparatus for continuous casting of a thin slab by reducing the thickness of a slab with liquid core, the slab having a liquid plus solid phase after having been withdrawn from a mold.

2. Description of the Related Art

In the continuous casting of thin slabs, molten steel tends to erode or clog an immersion nozzle. Therefore, it is difficult to reduce the outer diameter of an immersion nozzle beyond a certain value. The restriction on the outer diameter of the immersion nozzle further causes a lower limit on the width of the narrow side of the mold, i.e., the thickness of the slab. This applies particularly to conventional continuous casters for the manufacture of slabs with a nearly constant thickness, in which only amounts of solidification shrinkage are taken into account. Thus, it is difficult to manufacture thin slabs with conventional continuous casters.

In one known method for making a thin slab by continuous casting, the thickness of a slab is reduced by rolling when a liquid plus solid phase remains inside the slab.

For example, Japanese Patent Application Laid-open (kokai) No. 2-20650 discloses a continuous casting and rolling process which defines a total ratio of reduction with respect to the thickness of a slab in a solidifying interval. According to the process of this reference, the thickness of the slab is reduced by at least 10%, or even 70%, within the solidifying interval of the slab. This process has the drawback that unless a proper amount of reduction is shared with each reduction roller, slab quality becomes poor, and particularly, internal cracks form inside the slab.

The formation of internal cracks in a slab is greatly affected by a tensile strain applied to the slab (hereinafter simply referred to as a strain). The strain includes a strain caused by reduction of bulging using support rollers, bending strain, unbending strain, misalignment strain, strain due to thermal stress, and strain caused by reduction of a strand with liquid core. These are collectively called "internal strain".

In a continuous casting process of steels disclosed in Japanese Patent Application Laid-open (kokai) No. 3-174962, it is disclosed that internal cracks of a slab are generated when a maximum value of accumulated strain exceeds a critical strain corresponding to the specific type of steel. This accumulated strain results from the histories of the above-mentioned strains excepting strain caused by reduction with liquid core. In addition, the accumulation region for each strain corresponds to the temperature region between a zero strength temperature (ZST, at which a strain begins to occur due to stress applied to the slab in the solidifying process of strand) and a zero ductility temperature (ZDT), and that the ZST and ZDT nearly correspond to solid fractions 0.8 and 0.99, respectively.

Methods for reducing the thickness of a slab with a liquid core in a continuous caster having a curved segment, include: (a) a method using one pair of rollers, (b) a method using multiple pairs of rollers, (c) a method using connected segment frames, and (d) a method using a single segment frame.

(a) Method using one pair of rollers

This method utilizes a pair of reduction rollers (a rolling machine) or forging equipment placed just after the exit of a mold or in a horizontal section of the caster following a section for unbending the strand. See, for example, Japanese Patent Application Laid-open (kokai) Nos. 63-60051 and 3-124352.

This method has the following problems. If the amount of reduction is great and the reduction rate (or reduction incline) is fixed, the diameter of the reducing roller, the size of the press head, and the reduction force all increase, placing a significant burden on reducing equipment. On the other hand, if the roller diameter and the size of the press head are somewhat limited, the reduction rate rises, increasing the chance of generating internal cracks inside the slab. It is also noted that the primary object of this method is to improve the quality of the inside part of a slab by soft reduction performed in the vicinity of a crater end.

(b) Method using multiple pairs of rollers

In this method, the problems involved in the above method (a) are solved by providing each pair of rollers disposed in a curved segment with a hydraulic cylinder. The cylinders are independently moved up and down to effect reduction. This method also achieves a prolonged reduction zone. See, for example, Japanese Patent Application Laid-open (kokai) No. 2-52159.

Since this method allows each reduction roller to be adjusted vertically in accordance with continuous changes in the thickness of a slab from the start of casting to reduction, changes in reduction patterns or in reduction zones are properly followed. In addition, by starting reduction in a curved segment wherein the slab has a small solidifying thickness, it is also possible to use less reduction force.

However, this method requires a considerable number of roller pairs, and it is complicated to control the amount of reduction in the direction of thickness of the slab. Moreover, huge equipment is required, which is not desirable.

(c) Method using connected segment frames

In an attempt to avoid the above-mentioned problems, a method has been proposed in which a plurality of upper roller segment frames are connected and moved up and down.

FIG. 1 is a schematic side view showing an example of this method. As illustrated, one end (where reduction starts) of upper roller segment frame 12-1 is rotatably connected to frame 13 by a fixing pin 14. The upper roller segment frame 12-1 and another upper roller segment frame 12-2 located downstream of the frame 12-1 are rotatably connected by a connecting pin 16. Number 18 indicates a lower roller segment frame having lower reduction rollers 5', 1*a* is a slab with liquid core, and 10 is a thin slab.

The portions connected by the connecting pin 16 are lowered using an elevating machine for reduction (a reduction cylinder or a reduction worm jack) 15, in order to reduce the thickness of a slab with liquid core 1*a* between the upper and lower roller groups 5 and 5'. At this time, a passline for reducing the strand is determined between lower reduction roller group 5' placed on the lower roller segment frame 18 and the upper roller segment frame 12-1 by rotating the latter around the fixing pin 14. This method not only greatly reduces the number of elevating machines 15, but also achieves simple operation.

Although this method of employing connected segment frames is effective in smoothing the difference in the amounts of reduction in different segments, it cannot avoid the following problem, which is peculiar to the connected structure when the reduction amount is large.

That is, if upper and lower reduction rollers are placed so that each upper roller is directly opposite to one lower roller in an imaginary passline in which reduction is not performed, (i.e., in a passline with a constant gap here the thickness of the slab is constant from the outlet of the mold to the end of the continuous caster), there is an excessively wide distance between the upper reduction roller placed at the leading end in the upper roller segment frame and performing final reduction, and the roller placed downstream and adjacent to this roller.

FIG. 2 is a schematic longitudinal sectional view taken along the passline, and explains the above phenomenon. As shown in FIG. 2, when a slab with liquid core 1*a* undergoes reduction between upper and lower roller groups arranged so that each roller opposes another roller on a pre-reduction passline 39, with hydraulic cylinders 4 and upper roller segment frames 12 (12-1 to 12-3), the distance $L_1$ between the upper reduction roller 5 placed at the leading end in upper roller segment frame 12-3 performing the final reduction and the roller 17 which is placed downstream and is adjacent to this roller is expanded to $L_2$.

Conversely, if the upper and lower rollers are arranged with each roller opposing another roller on a tapered passline representing the reduction profile, the upper reduction roller placed at the leading end in the upper roller segment frame and performing final reduction interferes with the roller placed downstream and adjacent to this roller.

FIG. 3 is a schematic longitudinal sectional view taken along the passline, and illustrates the above phenomenon. As shown in FIG. 3, under conditions in which upper and lower roller groups are arranged so that each roller faces another roller on a tapered passline 40 representing the reduction profile, the upper roller 5, placed at the leading end in the upper roller segment frame 12-3 and performing final reduction, interferes with the roller 17 placed downstream and adjacent to this roller. Thus, an interval $L_1$ necessary for securing $L_2$ cannot be reserved.

In order to allow upper roller segment frames on the upstream side to descend, the adjacent upper roller segment frame on the downstream side must simultaneously descend. Therefore, reduction cannot start until a slab with the thickness of solidified shell allowing the upper roller segment frame 12-3 (placed on the far downstream side) to start reducing has passed through the leading end of the upper roller segment frame 12-3, i.e., the entire reduction zone. This means that an unsteady portion is prolonged, thereby reducing yield. Especially just after reduction operation starts, the slab is not rigid over the entire reduction zone. This permits upper roller segment frames to fall to the passline expected at the time of reduction, allowing the spouting of molten steel. This is dangerous, as the molten steel might leak from the upper portion of the mold. In a continuous caster, intervals between reduction rollers are kept small in order to prevent bulging. Therefore, the fixing pin 14, connecting the upper roller segment frame 12-1 on the upstream side, is often placed on the downstream side of the first upper reduction roller 5 in the upper roller segment frame 12-1 on the far upstream side. In this case, reduction by the upper roller segment frame 12-1 on the upstream side lifts up the upper reduction roller 5 on the upstream side of the fixing pin 14 as the upper roller segment frame 12-1 rotates. Refer to the numeral 41 in FIG. 2 and FIG. 3.

As described above, since the start position of reduction is fixed and upper roller segments 12 are connected with each other, the position of the upper and lower reduction roller groups 5 and 5' is predetermined for each amount of reduction and each reduction pattern. Therefore, if amounts of reduction or reduction patterns are desired to be changed, the whole caster must be stopped for changing the position of the upper and lower reduction roller groups 5 and 5'. Moreover, when a change is made to the thickness of slab as a result of a change of the mold, the distance between one of the upper roller segment frames 12 and its opposite lower roller segment frame 18 must be adjusted each time the mold is changed.

(d) Method using a single segment frame

This is a method in which a tapered reduction pass line is obtained by use of a single segment frame (see, for example, Japanese Utility Model Registration Application (kokai) Nos. 64-15467 and 64-49350).

This method was developed in an attempt to improve the inner quality of continuously cast strands. According to this method, a soft reduction of as much as 0.5 to 2.0 mm/m is performed primarily in the final stage of solidification of a strand. Thus, this method is not free from the below-described problems particularly when a great amount of reduction is performed.

In the reduction apparatus described in Japanese Utility Model Registration Application (kokai) No. 64-15467, control of the passline during reduction is carried out by adjusting the position of four reduction cylinders (two for each of inlet and outlet sides) which are provided for each segment frame. As the slab temperature and the thickness of a solidified shell of a slab vary, the reduction force also varies to cause a change in passline. As a result, the thickness of the resulting products varies. In addition, the precision of a displacement detector for cylinders also serves as a factor causing a difference in the thickness of the products.

Since mechanical gaps and wear in the linking portions of piston rods and trunnion portions which are connected to the aforementioned reduction cylinders bring about misalignment of reduction rollers, those portions must have a high precision and excellent wear resistance.

In the reduction apparatus described in Japanese Utility Model Registration Application (kokai) No. 64-49350, the center of rotation of an upper roller segment frame must coincide with the center of the spherical washer at the upper end of a column spacer and also with the center of the spherical bush of a guide which guides the direction of casting. If they do not coincide, the spherical washer and bush are abnormally worn out to permit the risk of a wrong passline during reduction.

When the amount of reduction is great, a large gap is needed between a column spacer and an upper roller segment frame and between the linking portion of reduction clamps and the portion of a cylinder support pierced by an upper roller segment. Therefore, equipment becomes large.

In steady casting and in reduction, the passline is defined by screw spacers. So, upon starting reduction, it is necessary that a press force be changed after the screw spacers are lowered. This operation needs a prolonged time before the passline is reached. As a result, the length of a strand which is in the transition period during which the strand is reduced to a target thickness increases, producing a tapered slab with an uneven thickness and worsening the yield.

As described above, although the reduction facilities disclosed in these publications may be suitable for tapered reduction in a horizontal section, i.e., in the final stage of solidification of a strand, they are not suitable for the sizing of a strand, in which a great reduction force is applied to a slab with liquid core in the curved segment.

The method described in Japanese Patent Application Laid-open (kokai) No. 3-174962 does not provide for the prevention of internal cracks generated during reduction of a slab with liquid core. Therefore, in the case of continuous casting of a thin slab by rolling a strand with liquid core to reduce its thickness, no means is provided for making the maximum accumulated strain between the zero strength temperature (ZST) and the zero ductility temperature (ZDT) equal to or less than a critical strain.

In order to improve productivity, increase of a casting speed is desired (2.5 to 6 m/min). In the case where a continuous caster for manufacturing a thin slab with a thickness of 70 to 150 mm is used, bulging between rolls increases as the casting speed increases, adding a bulging reduction strain by rolls (hereinafter referred to as a bulging strain) to a strain caused by reduction of a strand with liquid core, increasing the risk of internal cracks.

In such a case where a bulging strain is added to a strain caused by reduction of a strand with liquid core, the maximum value of the sum of various types of strains increases and tends to become greater than the critical value. As a result, the risk of internal cracks increases accordingly. Therefore, not only decrease of the strain caused by reduction of a strand with liquid core, but also suppression of a bulging strain is an important issue in the manufacture of a thin slab by effecting a reduction of a strand with liquid core in high speed casting.

SUMMARY OF THE INVENTION

Accordingly, an object of the present invention is to provide a method for continuous casting of a thin slab without internal cracks, in which reduction rollers are controlled to effect a suitable amount of reduction, or in addition, they are placed at suitable positions in a continuous caster, or in addition, cooling conditions of a strand are optimized. Another object of the present invention is to provide an inexpensive apparatus for effecting the above method, the apparatus being capable of flexibly adapting itself to changes in reducing conditions, etc.

The above objects can be achieved by any one of the methods or apparatuses described below.

(1) A first method for continuous casting of a thin slab comprises a step of reducing, with a plurality of pairs of reduction rollers, each pair being capable of effecting reduction, the thickness of a slab with liquid core having a liquid plus solid phase after being withdrawn from a mold while the slab is supported by support rollers and continuously drawn. The plurality of pairs of reduction rollers are placed between a location directly below the mold and the point of complete solidification. The amount of reduction per pair of reduction rollers, $P_k$, defined by the amount of reduction (mm) from the preceding reduction roller satisfies the following expression:

$$P_1 \geqq P_2 \geqq P_3 \geqq \cdots \geqq P_k,$$

excepting the case where all amounts of reduction are equal to one another. k is the number allotted to each pair of the reduction rollers so that the amount of reduction effected by an upstream reduction roller is controlled to be not less than the amount of reduction effected by a downstream reduction roller for suppressing strain due to reduction of a strand with liquid core.

(2) A second method for continuous casting of a thin slab comprises a step of reducing, with a plurality of pairs of reduction roller blocks, each block pair having a plurality of pairs of rollers being capable of effecting reduction, and the thickness of a slab with liquid core having a liquid plus solid phase after being withdrawn from a mold while the slab is supported by support rollers and continuously drawn. The plurality of pairs of reduction roller blocks are placed between a location directly below the mold and the point of complete solidification. The amount of reduction per pair of reduction rollers in each of the reduction roller blocks, $P_{i,j(i)}$, defined by the amount of reduction (mm) from the preceding reduction roller in the same reduction roller block satisfies the following expressions:

for a first block: $P_{1,1(1)} = P_{1,2(1)} = P_{1,j-1(1)} = \cdots = P_{1,j(1)}$ for a second block: $P_{2,1(2)} = P_{2,2(2)} = \cdots P_{2,j-1(2)} = P_{2,j(2)}$

. . .

for an $i$-th block: $P_{i,1(i)} = P_{i,2(i)} = \cdots P_{i,j-1(i)} = P_{i,j(i)}$ and in addition, $$P_1(1) \geqq P_{2,1(2)} \geqq \cdots \geqq P_{i,1(i)},$$

excepting the case where all amounts of reduction are equal to one another. i is the number allotted to each pair of the reduction roller blocks and j(i) is the number of pairs of reduction rollers in an i-th reduction roller block so that any roller pair in the same reduction roller block effects the same amount of reduction, so that the amount of reduction per reduction roller effected by an upstream reduction roller block is controlled to be not less than the amount of reduction effected by a downstream reduction roller block, and so that the mean difference of reduction incline ($R_i - R_{i+1}$) is reduced, wherein $$R_i(\%) = \left( \sum_{n=1}^{j(i)} P_{i,n}/La_i \right) \times 100 \tag{1}$$

$La_i$ is the length of a block (mm) of the i-th reduction roller block for suppressing strain due to reduction of a strand with liquid core.

(3) A third method for the continuous casting of a thin slab is as described in (1) or (2) above, with the modification that a continuous caster having a curved segment is used for reducing the thickness of a slab with liquid core having a liquid plus solid phase, and reduction is performed within a circular arc having a certain radius of curvature for suppressing bending strain and/or unbending strain.

(4) A fourth method for the continuous casting of a thin slab is as described in any one of (1), (2), or (3) above, with the modification that, when the thin slab is for hot rolling coil, the thickness of the slab at the outlet of the mold is 70–150 mm, the casting speed is 2.5–6 m/min, the pitch of slab-supporting rollers and reduction rollers is 100–250 mm, and the specific water ratio of secondary cooling is 1.5–4.5 liters/(kg-steel) for suppressing a bulging strain.

(5) A first apparatus for the continuous casting of a thin slab comprises a curved segment, and at least one reduction roller block for reducing a slab with liquid core provided in the curved segment. The reduction roller block comprises an upper roller segment frame for raising and lowering upper reduction rollers, a plurality of upper reduction rollers provided beneath the upper roller segment frame, a moving device for moving the upper roller segment frame up and down, a fixed upper frame of a gate shape for accommodating the moving device, upstream and downstream guide shafts which are fixed to the upper roller segment frame, an upper limit stopper for the upstream guide shaft, a lower limit stopper for the upstream guide shaft, and a casting direction guide for the upstream guide shaft, each being fixed to the fixed upper frame, and an upper limit stopper for the downstream guide shaft and a lower rotation limit stopper which controls the rotation of a downstream guide shaft, each being fixed to the fixed upper frame, and a lower roller segment frame including a plurality of lower reduction rollers and provided beneath the fixed upper frame of a gate shape. The upper roller segment frame is connected with the fixed upper frame so that the upper roller segment frame, simultaneous with the up and down movement of the upstream guide shaft along with the casting direction guide, is permitted to move up and down in the normal direction connecting the center of the curved segment and the center of the upper roller segment frame (hereinafter referred to as the direction normal to the curved portion) and also so that the upper roller segment frame is permitted to rotate about the center of the upstream guide shaft between the upper limit stopper of the downstream guide shaft and the lower rotation limit stopper which controls the rotation of a downstream guide shaft while the upstream guide shaft is pressed against its lower limit stopper, whereby misalignment is prevented.

One characteristic feature of this apparatus is that, when reduction is performed by moving the upper roller segment frame downward, the upper roller segment frame is not only moved straight in the direction of thickness of a slab and in the direction normal to the curved portion (shown in FIG. 14 and described below), but also the downstream portion of the upper roller segment frame is allowed to rotate about the center of the upstream guide shaft, with the upper guide shaft being pressed against the lower stopper for the upstream guide shaft. With this structure, when the passline of a slab before being reduced is taken as a reference, the deviation of the position of the upper reduction rollers after reduction is performed from the passline of a slab after regular reduction is performed is minimized. Also, when the passline of a slab after being reduced is taken as a reference, the deviation of the position of the upper reduction rollers before reduction is performed from the passline of a slab after regular reduction is performed is minimized. In short, the present invention comprises a reduction block including guides, guide shafts, and stoppers specifically arranged so as to achieve the above operation.

(6) A second apparatus for the continuous casting of a thin slab is described in (5) above, with the modification that the reduction block further comprises a device for varying the position of each of the upper limit stopper, lower limit stopper, and lower rotation limit stopper for controlling rotation as well as a controlling device therefor, thereby avoiding a halt of casting due to adjustment work for changing the thickness of a slab during casting or adjusting the amount of reduction.

This apparatus includes a reduction block which is capable of changing, during casting, the stroke of up and down movement and rotation angle of the upper roller segment frame for the thickness of a slab, amount of reduction, and the reduction pattern to be changed during casting.

BRIEF DESCRIPTION OF THE DRAWINGS

FIG. 18 is a table showing the chemical composition of a steel used in examples and its critical strain.

FIG. 19 is a table showing the reduction conditions in Test 1 and incidence of internal cracks.

FIG. 21 is a table showing the reduction conditions in Test 2 and incidence of internal cracks.

FIG. 23 is a table showing the reduction conditions in Test 3 and incidence of internal cracks.

FIG. 24 is a chart showing the relationship among total accumulated strain, the distance from the meniscus, and the critical strain in Test 3.

FIG. 25 is a chart showing the deviation of the slab passline from that before reduction in the case where upper reduction rollers were placed so that they were directly opposed to lower reduction rollers in the passline during reduction in Test 5.

DESCRIPTION OF PREFERRED EMBODIMENTS

As described above, internal cracks formed in a slab during continuous casting are caused by internal strain generated at the solidifying front of the slab. Primary factors causing internal strain include bulging between rollers due to the static pressure of a melt; bending and unbending by rollers in the course of drawing a slab; misalignment of support rollers, bending rollers, and unbending rollers; thermal stress; and reduction of a strand with liquid core.

Figure 4:
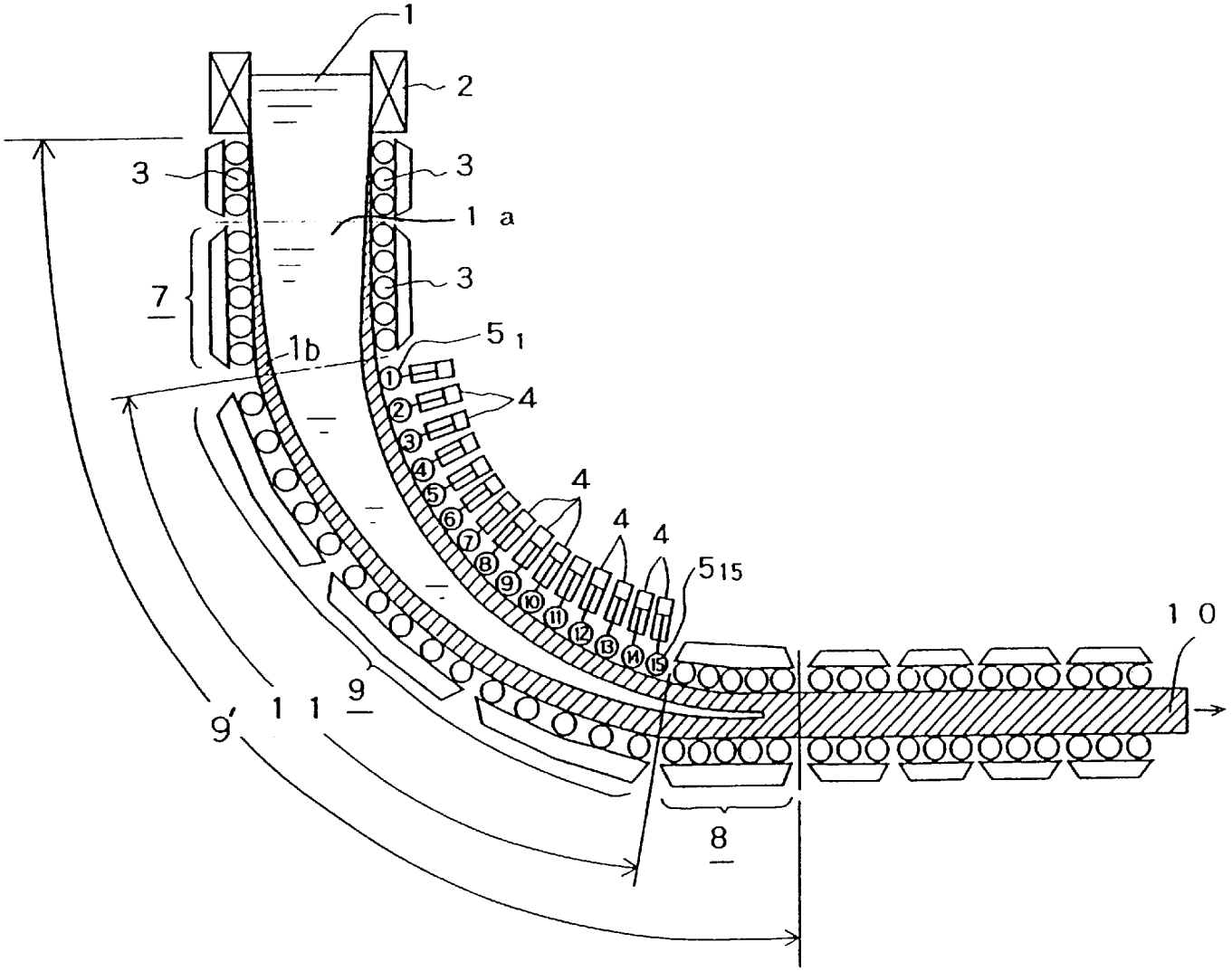
FIG. 4 is a schematic longitudinal sectional view taken along the passline of a continuous caster provided with a plurality of pairs of reduction rollers to which the first or third method of the present invention may be applied.

FIG. 4 is a schematic longitudinal sectional view taken along the passline of a continuous caster including a plurality of pairs of reduction rollers. This apparatus is taken as an example to which the first method of the present invention is applied for the purpose of suppressing the strain caused by reduction of a strand with liquid core. The apparatus shown in FIG. 4 is a continuous caster of a vertical bending type (VB type). The first method of the present invention may be applied also to an S type (curved type) continuous caster or to a vertical type continuous caster.

A reduction zone 9 consists of a plurality of pairs of reduction rollers $\mathbf{5}_1$ to $\mathbf{5}_{15}$, each being linked to a hydraulic cylinder 4 so that roller pairs can each perform reduction in an independent manner. The location of the reduction zone 9 or the location of reduction roller pairs 5 is not particularly limited so long as it is between a location directly below a mold 2 and the point of complete solidification. However, it is preferred that the location is between a bending zone 7 and an unbending zone 8 as shown in FIG. 4.

Molten steel 1, after being poured into the mold 2, gradually solidifies as it is cooled by secondary cooling spray groups (not shown) provided in a secondary cooling zone 9' to become a slab having liquid core 1*a*. The slab is continuously drawn while being supported by support rollers 3.

In the case where an apparatus shown in FIG. 4 is used for the manufacture of a thin slab 10, the risk of generating strain due to reduction of a strand with liquid core at a solidifying front would be added to the above-mentioned factors which cause internal cracks (other than strain due to reduction of a strand with liquid core), if the thickness of the slab with liquid core 1*a* having a liquid plus solid phase is reduced using the reduction roller groups 5 which advance and retract by the hydraulic cylinders 4. As a result, internal cracks often occur in the thin slab 10 manufactured by a simple reduction using reduction roller groups 5.

The present inventors discovered that formation of internal cracks in a slab can be prevented by accounting accumulation of strain caused by reduction of a strand with liquid core between the zero strength temperature (ZST) and the zero ductility temperature (ZDT) in a continuous caster. The present inventors calculated the strain using a finite element method (hereinafter referred to as an FEM).

Their discovery is described here in detail.

Figure 1:
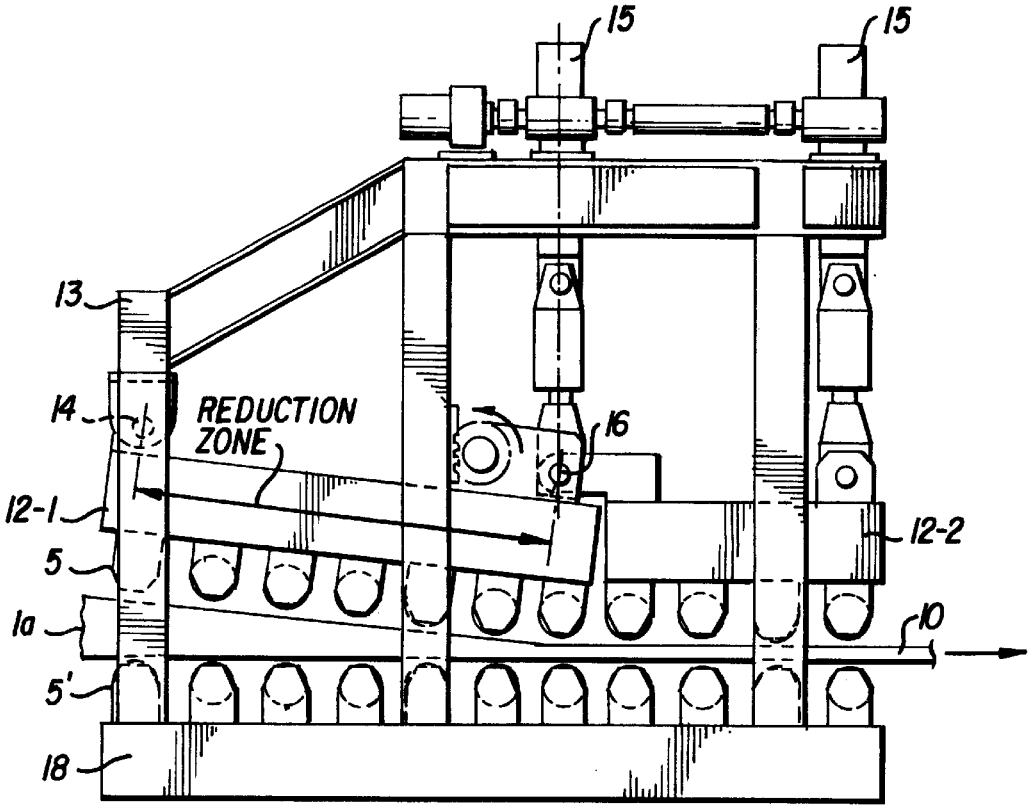
FIG. 1 (PRIOR ART)
FIG. 1 is a side view showing an example of a conventional reduction method employing connected segment frames.
Figure 5:
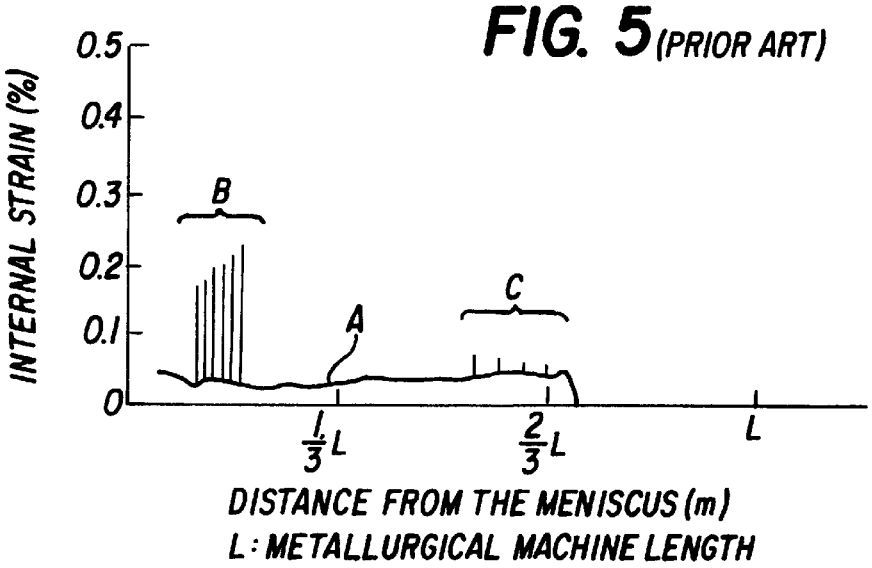
FIG. 5 (PRIOR ART)
FIG. 5 is a chart showing the relationship between internal strain generated when a conventional continuous caster is used (in which reduction of a strand with liquid core is not carried out) and the distance from the meniscus. In this chart, accumulation of strains is not considered.

FIG. 5 is a chart showing the relationship between internal strain generated when a conventional continuous caster is used (in which reduction of a strand with liquid core is not carried out) and the distance from the meniscus. In FIG. 5, A indicates bulging strain generated during casting, B indicates bending strain, and C indicates unbending strain. They were all calculated using an FEM. The incidence of the internal strains shown in FIG. 5 is typical for a continuous caster except for the location and number of bending and unbending.

As described in Japanese Patent Application Laid-open (kokai) No. 3-174962, internal cracks are generated in a slab when a maximum value of accumulated strain (which is calculated accounting for the histories of strains) exceeds a critical strain corresponding to the specific type of steel. Strains accumulate in a region between the zero strength temperature (ZST, corresponding to solid fraction: 0.8) and the zero ductility temperature (ZDT, corresponding to solid fraction: 0.99) in the process of solidification of a slab.

A critical strain is about 0.9% in the case where the C content is between 0.2 and 0.3 mass %.

Figure 6:
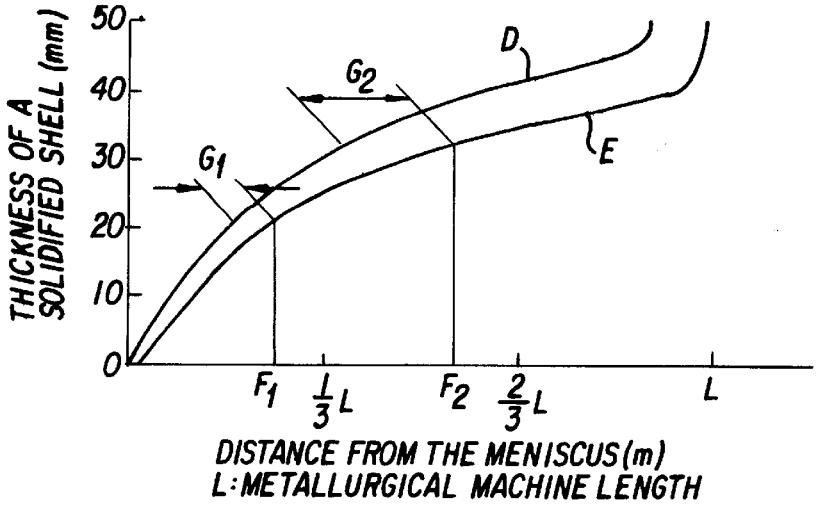
FIG. 6 (PRIOR ART)
FIG. 6 is a graph showing the relationship between the thickness of a solidified shell corresponding to the zero strength temperature (ZST) [solid fraction: 0.8] and the zero ductility temperature (ZDT) [solid fraction: 0.99] and the distance from the meniscus in the case where the thickness of a slab is 100 mm.

FIG. 6 is a graph showing the relationship between the thickness of a solidified shell corresponding to the zero strength temperature (ZST) [solid fraction: 0.8] and the zero ductility temperature (ZDT) [solid fraction: 0.99] and the distance from the meniscus in the case where the thickness of a slab is 100 mm. In FIG. 6, curve D represents the thickness of a solidified shell in a slab when the solid fraction fs was 0.8, and curve E represents the corresponding thickness when the fs value was 0.99. The metallurgical machine length L was 13 m.

In the solidifying situation shown in FIG. 6, the region in which strains are accumulated in a slab (hereinafter referred to as the strain accumulative region) has a distance sandwiched by the above-mentioned two curves representing the thicknesses of solidified shells. As shown in FIG. 6, the strain accumulative region from the meniscus of a slab to a point a certain distance apart, for example, the strain accumulative region from the meniscus to point $F_1$ is denoted by $G_1$. Similarly, the strain accumulative region from the meniscus of a slab to point $F_2$ is denoted by $G_2$.

As is shown in FIG. 6, it is clear that accumulative strain region G becomes longer as the distance F from the meniscus increases (i.e., in the direction from upstream to downstream) excepting the final stage of solidification of a strand.

Figure 7:
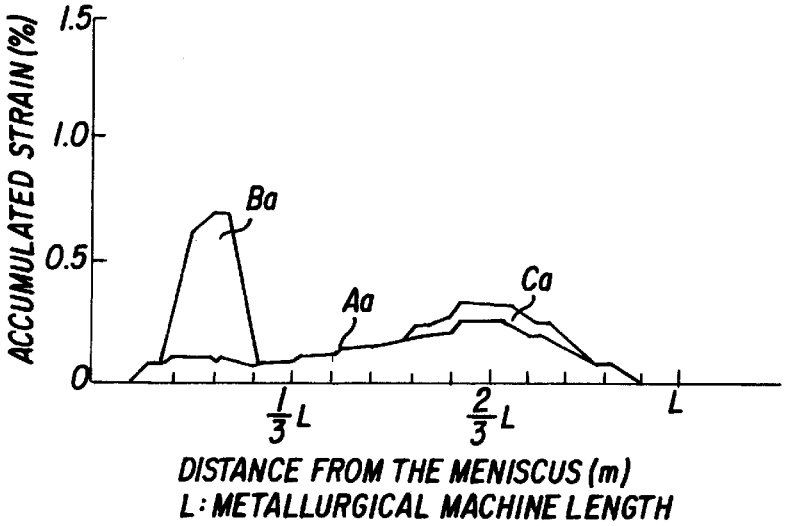
FIG. 7 (PRIOR ART)
FIG. 7 shows the relationship between accumulated strain attributed to internal strain generated when a conventional continuous caster is used (in which reduction of a strand is not carried out) and the distance from the meniscus.

FIG. 7 shows the relationship between accumulated strain attributed to internal strain and the distance from the meniscus. The accumulated strain shown in FIG. 7 is the result of accumulation of the internal strains shown in Fig.5 which are generated when a conventional continuous caster is used (in which reduction of a strand with liquid core is not carried out). In FIG. 7, Aa indicates an accumulated bulging strain, Ba indicates an accumulated bending strain, and Ca indicates an accumulated unbending strain. Accumulated strain is a sum (integral) of internal strains generated in the accumulative strain region G.

When the bulging strain A (which was uniformly generated in FIG. 5) is considered, since the accumulative strain region G becomes longer on the downstream side, the frequency of accumulation of bulging strain A increases. Therefore, accumulated bulging strain Aa becomes greater on the downstream side.

In the process of solidification that results in the accumulation of internal strains as shown in FIGS. 6 and 7, if the case is considered of also reducing a strand with liquid core, the frequency of accumulation of a strain caused by reducing a strand with liquid core increases on the downstream side.

Next, internal strains generated when a slab with liquid core having a liquid plus solid phase undergoes reduction by rollers and a total accumulated strain will be described with reference to FIG. 8.

Figure 8:
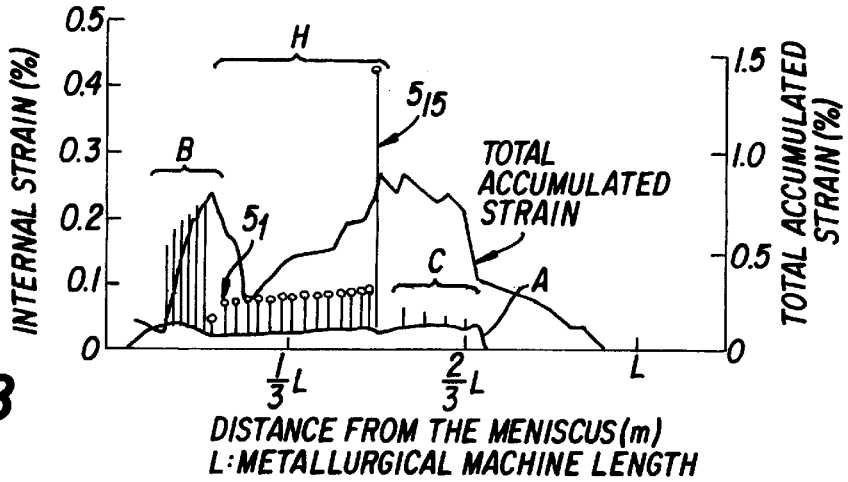
FIG. 8 shows the relationship among internal strain including strain caused by reduction of a strand with liquid core, total accumulated strain, and the distance from the meniscus.

FIG. 8 shows the relationship among internal strains including strain caused by reduction of a strand with liquid core, a total accumulated strain, and the distance from the meniscus. The internal strain was generated in a continuous caster when a slab with liquid core having a liquid plus solid phase is subjected to a thickness reduction using rollers. In FIG. 8, H indicates strains caused by reduction of a strand with liquid core when constantly increasing reduction amounts were applied to the fifteen pairs of reduction rollers 5 ($\mathbf{5}_1$ to $\mathbf{5}_{15}$) shown in FIG. 4. These strains were calculated by an FEM as were bulging strain A, bending strain B, and unbending strain C.

When the behavior of the solidified shell of the slab with liquid core 1*a* at the curved segment of the apparatus shown in FIG. 4 is considered, the solidified shell 1*b* bends to a greater degree at the portion corresponding to support roller 3 which support the bending zone 7 just above the first stage reduction roller $\mathbf{5}_1$, as well as the portion corresponding to the final reduction roller $\mathbf{5}_{15}$, in comparison to the portions corresponding to the other reduction rollers $\mathbf{5}_1$ to $\mathbf{5}_{14}$.

In the portion facing the support rollers 3 which support the bending zone 7 just above the first stage reduction roller $\mathbf{5}_1$, a compressive strain is generated at the solidifying front of the slab, and no significant strain is caused by reduction of a strand with liquid core. However, at the portion facing the final reduction roller $\mathbf{5}_{15}$, the strain caused by reduction of a strand with liquid core is significant. In portions facing the other reduction rollers, $\mathbf{5}_1$ to $\mathbf{5}_{14}$, the strains caused by reduction of a strand with liquid core are almost uniform. When these internal strains are taken in conjunction with the aforementioned accumulative strain region G, the total accumulated strain profile shown in FIG. 8 is obtained.

The first method of the present invention will next be described.

The length of the accumulative strain region G shown in FIG. 6 is considered in conjunction with the incidence of strain caused by reduction of a strand with liquid core as shown in FIG. 8, and with the total accumulated strain profile. A plurality of pairs of reduction rollers $\mathbf{5}_1$ to $\mathbf{5}_k$, each pair being capable of performing reduction, are placed from just under the mold to the point of complete solidification (see FIG. 4). The amount of reduction per pair of reduction rollers is defined by the amount of reduction (mm) from the preceding reduction roller, and is expressed by $P_k$. According to the present invention, a strand with liquid core is subjected to a thickness reduction in which the farthest upstream reduction roller $\mathbf{5}_1$ of a continuous caster (where accumulative strain region G is short) performs a great amount of reduction $P_1$. As the length of accumulative region G increases, a smaller amount of reduction $P_k$ is provided by a reduction roller $\mathbf{5}_k$. This can be expressed as follows:

$$P_1 \geqq P_2 \geqq P_3 \geqq \cdots \geqq P_k.$$

However, the case where all amounts of reduction are equal to one another is excluded. When reduction of a strand with liquid core is performed so that the above conditions are satisfied, generation of accumulated strain peculiar to reduction of a strand with liquid core (which is newly added as a result of reduction of a strand with liquid core) can be controlled according to the distribution of the accumulated strain before performing reduction of a strand with liquid core. Moreover, it is possible to suppress the maximum value of total accumulated strain. Thus, internal cracks are prevented from occurring.

Reduction by each of rollers $\mathbf{5}_1$ to $\mathbf{5}_k$ has a reduction incline defined as $R_k[=(P_k/Lb_k)\times 100\%]$, good effects in preventing internal cracks can be obtained by minimizing the difference in the reduction incline of adjacent reduction rollers, depending on the length of the accumulative strain region G and critical strain. The preferred difference in reduction incline is not more than 5% in the case of carbon steel. Here, $P_k$ is the amount of reduction (mm) effected by the k-th reduction roller pair, and $Lb_k$ is the roller pitch (mm) of the k-th reduction roller.

The second method of the present invention will next be described.

Figure 9:
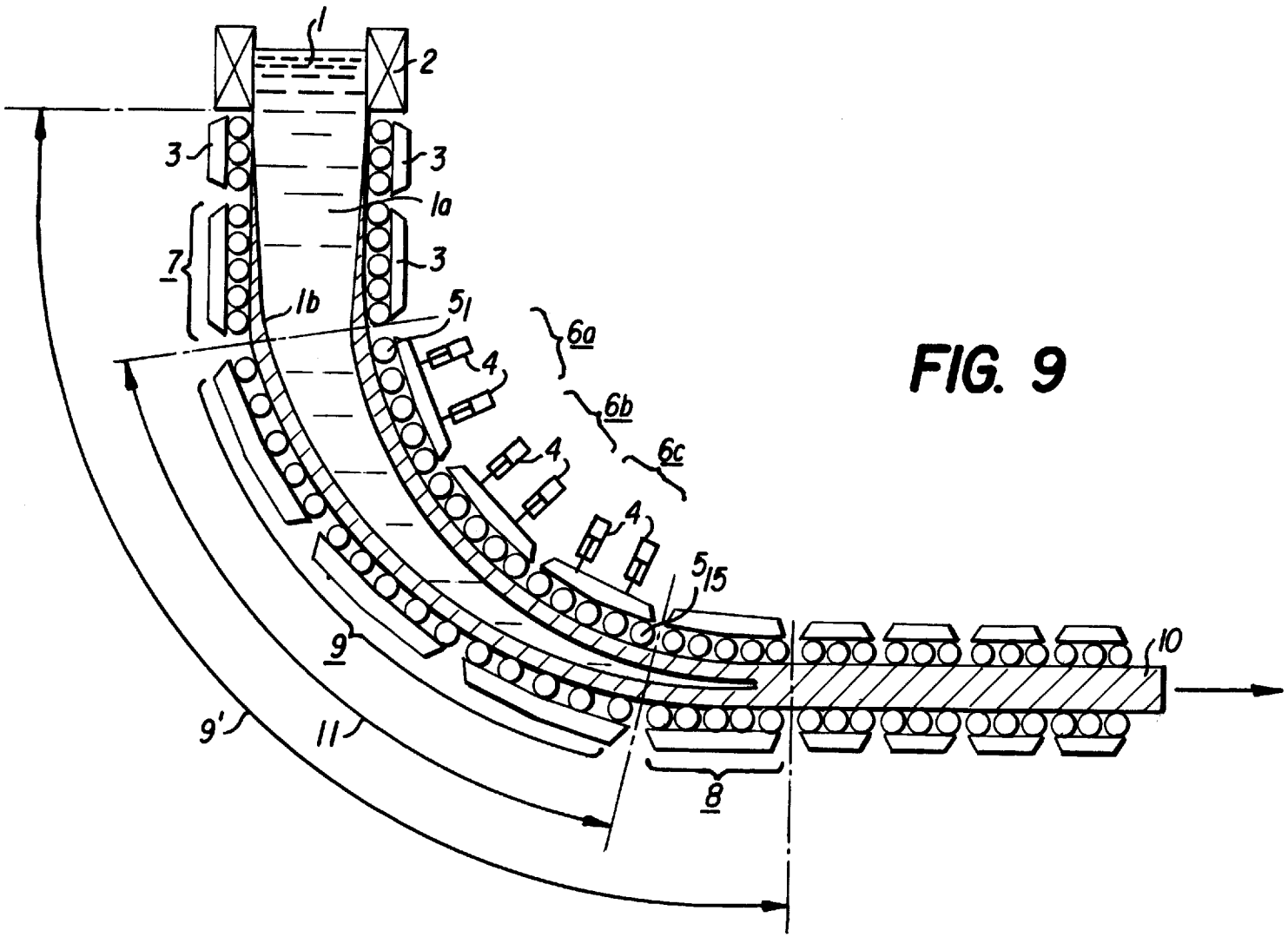
FIG. 9 is a schematic longitudinal sectional view taken along the passline of a continuous caster provided with a plurality of pairs of reduction roller blocks to which the second or third method of the present invention may be applied, in which reduction can be performed by each pair of blocks.

FIG. 9 is a schematic longitudinal sectional view taken along the passline of a continuous caster provided with a plurality of pairs of reduction roller blocks to which the second method of the present invention may be applied, in which the block pairs can each perform reduction in an independent manner. Although FIG. 9 shows a continuous caster of a VB type, S type- and vertical type- continuous casters can also be used. In FIG. 9, a reduction zone 9 consisting of three pairs of reduction roller blocks 6*a*, 6*b*, and 6*c* is located between a bending zone 7 and an unbending zone 8. This arrangement is recommended. However, the location of the reduction zone 9 is not particularly limited so long as it is between a location directly below a mold 2 and the point where complete solidification takes place on the downstream side of the final reduction roller after reduction has been performed.

In the case shown in FIG. 9, reduction roller blocks 6*a*, 6*b*, and 6*c* contain reduction rollers $\mathbf{5}_1$ to $\mathbf{5}_5$, $\mathbf{5}_6$ to $\mathbf{5}_{10}$, and $\mathbf{5}_{11}$ to $\mathbf{5}_{15}$, respectively. In order to allow the roller blocks to effect reduction independently, each roller block is linked to two hydraulic cylinders 4.

The continuous caster in FIG. 9, in which reduction rollers are grouped in blocks, is also useful for the manufacture of a thin slab. In this apparatus, the reduction blocks 6*a*, 6*b*, and 6*c* are advanced and retracted by a hydraulic cylinder 4 to reduce the thickness of a slab with liquid core 1*a*.

Reduction using reduction roller blocks involves difficulties in bringing the passlines before and after reduction to exactly coincide, relative to the first method of the present invention, where reduction is independently performed by each roller pair. However, the deviation between passlines before and after reduction can be minimized if a reduction roller layout is determined so as to optimize the passline after reduction, and if a suitable reduction apparatus or mechanism (see the first and second apparatuses which will be described below) is employed. In the event that it is difficult to bring the passlines before and after reduction to exactly coincide even though each of reduction rollers $\mathbf{5}_1$ to $\mathbf{5}_{15}$ in reduction roller blocks 6*a* to 6*c* is independently provided with a suitable reduction amount because the number of roller pairs $\mathbf{5}_1$ to $\mathbf{5}_{15}$ in the reduction roller blocks 6*a* to 6*c* is not sufficient, the first method of the present invention may be adopted.

In the second method of the present invention, an effective reduction of a strand with liquid core for avoiding an increase in accumulated strain can be performed by controlling the amount of reduction as was the case in the first method. That is, from the relationship among the length of the accumulative strain region G, strain caused by reduction of a strand with liquid core, and the distribution of a total accumulated strain shown in FIGS. 6 and 8, the first reduction roller block on the farthest upstream side, 6*a,* is controlled to perform a great amount of reduction, and the amount of reduction is diminished as the reduction proceeds to the second and then to the third reduction roller blocks 6*b* and 6*c*.

The strains generated in the solidified shell 1*b* of a slab with liquid core 1*a* between adjacent reduction roller blocks 6*a* and 6*b* or 6*b* and 6*c* will next be described. The shell 1*b* is bent due to the difference in mean reduction incline of reduction roller blocks 6*a* through 6*c*. As a result, at the solidifying front just under the final reduction roller in the farthest upstream reduction block, strain peculiar to reduction of a strand with liquid core is generated.

Therefore, according to the second method of the present invention, the following reduction is performed. For the sake of convenience, the number of reduction roller block pairs is referred to as i, and the number of reduction roller pairs in the i-th reduction roller block is referred to as j(i). The amount of reduction per pair of reduction rollers in one reduction block is defined by the amount of reduction (mm) from the preceding reduction roller pair in the same reduction roller block, and is expressed by $P_{i,j(i)}$. According to the present invention, a strand with liquid core is subjected to a thickness reduction such that the following conditions are satisfied.

for a first block: $P_{1,1(1)} = P_{1,2(1)} = --- P_{1,j-1(1)} = P_{1,j(1)}$ for a second block: $P_{2,1(2)} = P_{2,2(2)} = --- P_{2,j-1(2)} = P_{2,j(2)}$

. . .

for an *i*-th block: $P_{i,1(i)} = P_{i,2(i)} = --- P_{i,j-1(i)} = P_{i,j(i)}$ and in addition, $$P_{1,1(1)} \geqq P_{2,1(2)} \geqq --- \geqq P_{i,1(i)},$$

excepting the case where all amounts of reduction are equal to one another.

The mean reduction incline $R_i$ of each reduction block is defined as follows:

$$R_i(\%) = \left( \sum_{n=1}^{j(i)} P_{i,n}/La_i \right) \times 100 \quad (1)$$

wherein $La_i$ is the block length (mm) of the i-th reduction roller block. Strain caused by reduction of a strand with liquid core generated due to the difference in mean reduction incline of adjacent reduction roller blocks ($R_{i-1}-R_i$) can be suppressed by minimizing this difference ($R_i-R_{i+1}$). Thus, using a continuous caster in which reduction is performed by reduction roller blocks each acting in an independent manner, it is also possible to control generation of accumulated strain peculiar to reduction of a strand with liquid core according to the distribution of the accumulated strain before performing reduction of a strand with liquid core. Moreover, it is possible to suppress the maximum value of total accumulated strain. Thus, internal cracks are prevented from occurring. The preferred difference in reduction incline is not more than 5% in the case of carbon steel.

As described above, in both the first and the second methods of the present invention, internal cracks are prevented from occurring by controlling the accumulation of strain added by reduction of a strand with a liquid core.

Next, the third method of the present invention will be described.

In this method, a continuous caster having a curved segment is used. When a slab with liquid core having a liquid plus solid phase is subjected to a thickness reduction according to the first or second method of the present invention, reduction is performed in an area defined by a circular arc having a certain radius of curvature. This method is effective in suppressing an increase of total accumulated strain caused by bending strain and unbending strain, and resultantly in preventing generation of internal cracks in a thin slab.

In continuous casters having a curved segment (S-type and VB-type), unbending strain is caused in a S-type apparatus even before reduction is performed. Likewise, bending and unbending strains are caused in a VB-type apparatus in the same situation. When a VB-type apparatus shown in FIG. 4 is used and accumulation of strains is considered, large amounts of accumulated bending strain Ba and unbending strain Ca are generated in the bending zone 7 and in the unbending zone 8.

If the position of the reduction zone 9 is arbitrarily selected between a location just below the mold 2 and the point of complete solidification, or within a zone including the bending zone 7 and unbending zone 8 for reducing a slab with liquid core 1*a* using a continuous caster having a curved segment, strain peculiar to reduction of a strand with liquid core is further applied to a solidifying front where bending strain and unbending strain are generated from the start. As a result, internal cracks are generated inside a thin slab 10. Moreover, the total amount of reduction must be reduced in order to prevent internal cracks.

To avoid these problems, it is necessary that, regardless of reduction effected by individual rollers or reduction effected by individual reduction roller blocks, the position of the reduction zone 9, i.e., the location of reduction roller blocks 6, be within a range defined by a circular arc having a certain radius of curvature 11 as shown in FIGS. 4 and 9. This range 11 is such that reduction roller pairs 5 (which are on the downstream side of the bending zone 7 but on the upstream side of unbending zone 8) are disposed to form a circular arc having a certain radius of curvature.

When the reduction roller pairs 5 are so placed, addition of strain caused by reduction of a strand with liquid core to the vicinity of the maximum value of accumulated strains generated in the bending zone 7 and the unbending zone 8 can be avoided. Thus, control of the amount of reduction is facilitated. As shown in FIG. 8, overlapping of the portion in which strain H caused by reduction of a strand with liquid core is applied and the portions in which bending strain B and unbending strain C is avoided. This is the reason why strain caused by reduction of a strand with liquid core is not added to the vicinity of the maximum value of accumulated strains generated in the bending zone 7 and the unbending zone 8 to suppress an increase in total accumulated strain.

As described above, the third method of the present invention can easily suppress an increase in accumulated strains, and therefore, it is effective for preventing generation of internal cracks.

The fourth method of the present invention will next be described.

In this method, generation of internal cracks is prevented by avoiding a bulging strain from being added to strain caused by reduction of a strand with a liquid core to make a total strain so as not to exceed a critical strain when a thin slab is made by a high speed casting in which reduction is performed on a slab with a liquid core.

The casting conditions in the fourth method of the present invention are as follows. In this method, any one of the first to third methods is employed. The end product of the resulting thin slab is limited to hot coils. The slab thickness at the exit of a mold is between 70 and 150 mm, casting speed is between 2.5 and 6 m/min, pitches of slab supporting rollers and reduction rollers are between 100 and 250 mm, and the specific water ratio in the secondary cooling is between 1.5 and 4.5 liters/(kg-steel).

The 70 to 150 mm range of slab thickness is a suitable range for the manufacture of hot coils. The lower limit, 2.5 m/min, determined for the casting speed was selected so as to secure the productivity of a thin slab having the above thickness by continuous casting. On the other hand, when the upper limit, 6 m/min, is surpassed, surface quality of the resulting thin slab is poor.

In steel containing 0.2 mass % of C, critical strain for generating internal cracks is 0.9%, as shown in the examples described later herein. In order to prevent the generation of internal cracks, it is essential that the critical strain is obtained for each species of steel. A maximum C content in steel species for making hot coils is considered to be 0.3 mass %. According to the study performed by the present inventors, the critical strain for generating internal cracks in 0.3 mass % C steels is almost the same as that in 0.2 mass % steels, and is about 0.9%.

An accumulated strain resulting from reduction of a strand with liquid core can be reduced by the aforementioned first to third methods of the present invention. However, it is impossible to reduce to zero. We cannot but accept accumulated strain of as much as 0.2%. Accordingly, when 0.3 mass % C steel (which is the most susceptible to generation of cracks among a variety of steel species suitable for hot coils) is used, strains other than strain peculiar to reduction of a strand with liquid core must be suppressed to a value of less than 0.7% in order to prevent internal cracks, in view that the critical strain of this steel is 0.9%.

When steel species containing less than 0.3 mass % C are used, critical strains become even greater. Therefore, problems of internal cracks can be avoided if strains other than strain caused by reduction of a strand with liquid core are limited to less than 0.7%.

Other than the strain caused by reduction of a strand with liquid core, there are unavoidable bending strain, unbending strain, and bulging strain mentioned above. Regarding bending strain and unbending strain, their occurrence is limited only to a bending zone and an unbending zone as described above for the third method of the invention. Therefore, by performing reduction in regions free from their influence, a total accumulated strain can be reduced.

However, bulging strain is caused by all rollers. It becomes greater as the casting speed increases. Also, different rollers cause different bulging strains. Thus, the accumulated strain of bulging strain greatly increases. Accordingly, when strains other than strain peculiar to reduction of a strand with liquid core are considered, it is necessary that bulging strain is suppressed less than 0.7% for preventing internal cracks. Factors which affect bulging strain and which are controllable are the pitch of slab support rollers and reduction rollers and the specific water ratio in the secondary cooling other than the casting speed.

As shown in examples described below, the roller pitch is not the same for every roller interval. In many cases, it is slightly different as so required by the apparatus. Generally speaking, however, the roller pitch is almost the same in a certain range, and is not greatly changed between two adjacent rollers. Moreover, it is a general practice that the pitch is small in a zone on the upstream side and great in a zone on the downstream side. Thus, the roller pitch referred to in this specification indicates an average and typical pitch value in the support roller zone and reduction zone.

The reason why the pitch of support rollers must be considered in addition to that of rollers for reducing a strand with liquid core is that, in the case where accumulated strains are present in a wide range, the bulging strain that is generated on the upstream side of a reduction zone of a strand with liquid core also remains in a reduction zone of a strand with liquid core, and even on the downstream side of it, increasing a total accumulated strain including the bulging strain in that zone.

When a roller pitch is in excess of 250 mm and the specific water ratio of secondary cooling is less than 1.5 liters/(kg-steel), a bulging strain per pair of rollers increases to further increase a total accumulated strain.

Figure 10A:
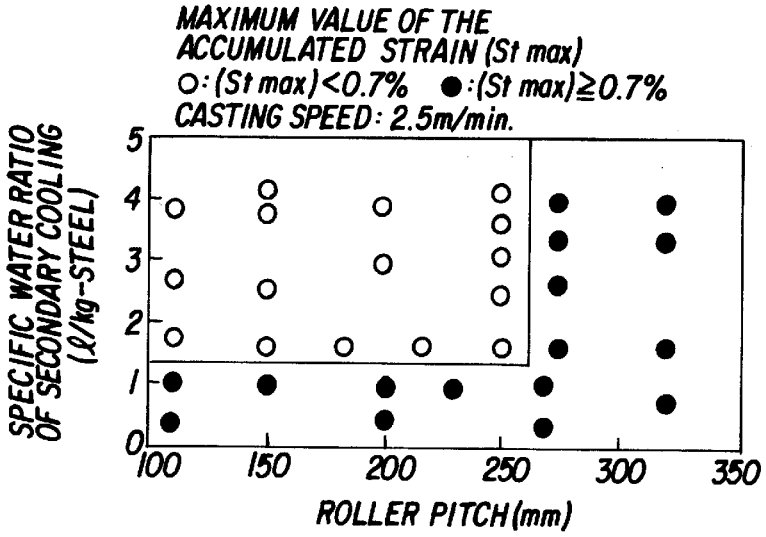
FIG. 10(*a*) to FIG. 10(*c*) show the relationship among the maximum value of the accumulated bulging strain of a thin slab, specific water ratio of secondary cooling, and the roll pitch.
Figure 10B:
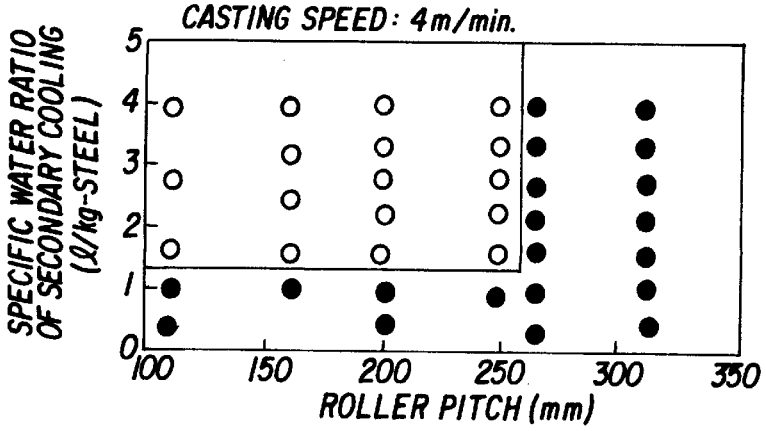
Figure 10C:
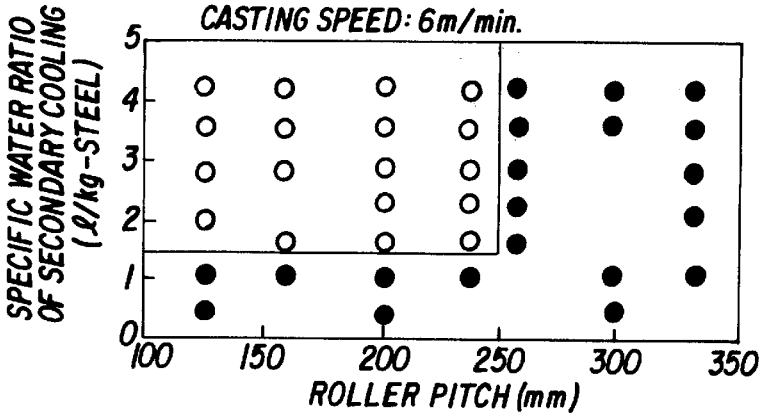

The above phenomenon is explained with reference to FIG. 10(*a*) to FIG. 10(*c*). FIG. 10(*a*) to FIG. 10(*c*) show the relationship among the maximum value of accumulated strain attributed to bulging (accumulated bulging strain) of a thin slab having a thickness of from 70 to 150 mm, specific water ratio of secondary cooling, and the roll pitch. In FIG. 10(*a*), the casting speed is 2.5 m/min, and in FIG. 10(*b*) and FIG. 10(*c*), it is 4 m/min and 6 m/min, respectively. The bulging strains were obtained as accumulated strain by a strain analysis in which creep deformation of a thin slab is taken into account.

As shown in FIGS. 10(*a*) to 10(*c*), at a casting speed of 6 m/min, accumulated bulging strains significantly increase when the roller pitch is in excess of 250 mm and the specific water ratio of secondary cooling is 1.5 liters/(kg-steel) to surpass the critical strain (0.7%). When the casting speed is not more than 4 m/min, the critical roller pitch is greater than 250 mm and the critical specific water ratio is less than 1.5 liters/(kg-steel).

As mentioned above, when a high speed casting is performed under conditions where the slab thickness is from 70 to 150 mm and the casting speed is from 2.5 to 6 m/min, the maximum accumulated bulging strain can be made less than 0.7% (the allowable value as mentioned before) by setting the roller pitch of slab support rollers and reduction rollers not more than 250 mm and the specific water ratio of secondary cooling is not less than 1.5 liters/(kg-steel).

The roller diameter places a limitation to the lower limit of the roller pitch. In cases of high speed casting, it cannot be made very small due to a great thermal load. A minimum but realistic diameter of a roller is 100 mm. Therefore, the lower limit of a roller pitch is considered as 100 mm. On the other hand, when a secondary cooling is performed, a strong cooling with a great specific water ratio significantly lowers the slab temperature and increases the resisting force of unbending, and in some cases, withdrawing of a slab may not be possible. In order to prevent this, the upper limit of the specific water ratio of secondary cooling is 4.5 liters/(kg-steel).

Next, the first apparatus of the present invention is described.

Generally speaking, the radius of a curved segment of a continuous caster is about 3 to 15 m. When a great amount of reduction is performed on a strand with liquid core by advancing and retracting upper roller segment frames provided at the curved segment, the casting radius of the passline defining the upper slab surface during reduction deviates from that during casting before reduction.

The present inventors noted that the thickness of a slab (and the amount of reduction) is (are) significantly smaller than the casting radius, and therefore, the change rate of the casting radius is quite small. They thought that the position of rollers in upper roller segment frames may be univocally determined regardless of the presence or absence of reduction if the two slab passlines (before and after reduction) are superposed one on another.

In one embodiment of this invention, the upper roller segment frames are rotated in agreement with the amount of shifting of the casting radius center before and after reduction to bring the two passlines to be approximately superposed. By this method, misalignment strains can be mitigated.

An example of the structure of the first apparatus of the present invention is described with reference to FIGS. 11 and 12.

Figure 11:
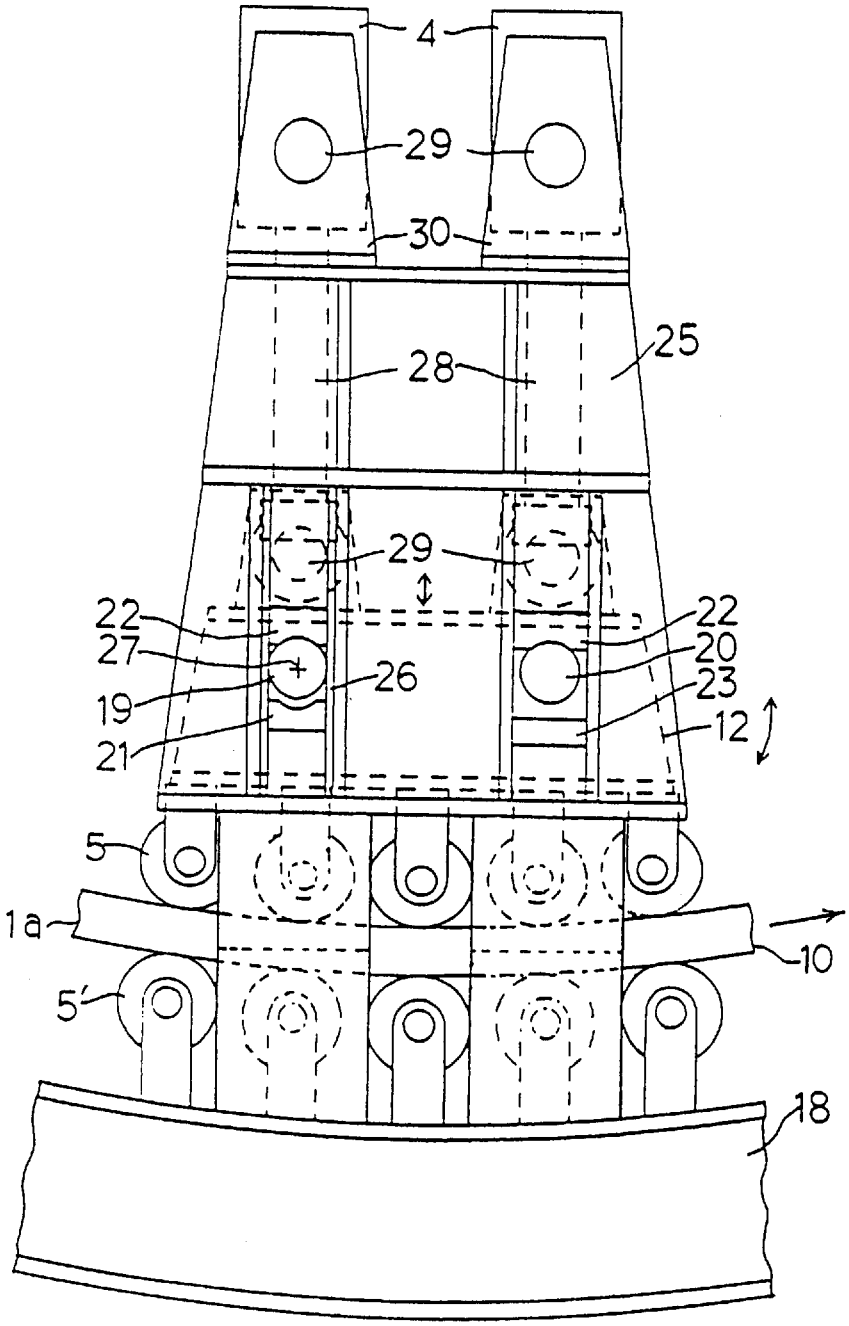
FIG. 11 is a schematic longitudinal sectional view showing the general structure of one reduction block used in the first apparatus of the present invention.

FIG. 11 is a schematic longitudinal sectional view showing the general structure of one reduction block used in the first apparatus of the present invention. FIG. 12 is a fragmentary schematic longitudinal sectional view showing a continuous caster having a curved segment and at least one reduction block for the curved segment.

Figure 12:
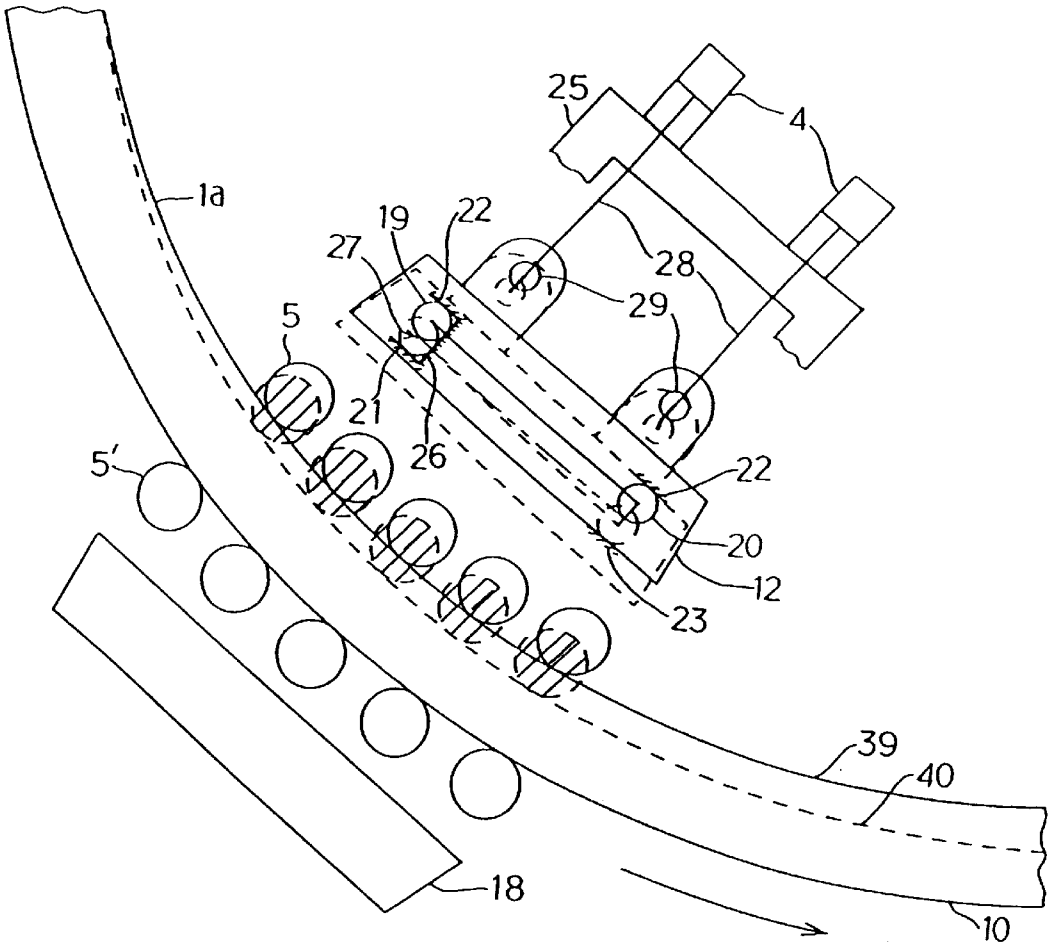
FIG. 12 is a fragmentary schematic view of a longitudinal section showing a continuous caster having a curved segment and at least one reduction block for the curved segment.

As shown in FIGS. 11 and 12, one reduction block comprises an upper roller segment frame 12 for advancing and retracting upper reduction rollers 5, upper reduction rollers 5 provided beneath the upper roller segment frame 12, an upstream guide shaft 19 and an downstream guide shaft 20 which are fixed to the frame 12, a device for moving the frame 12 up and down, for example, hydraulic cylinders 4, a fixed upper frame 25 of a gate shape for accommodating the hydraulic cylinder 4, a lower limit stopper 21 and an upper limit stopper 22 for determining the halt position of the guide shafts 19 and 20, respectively, a lower rotation limit stopper 23 which controls the rotation of a downstream guide shaft, and a casting direction guide 26 for guiding the movement of the upstream guide shaft 19.

Moreover, the reduction block has a lower roller segment frame 18 for supporting lower reduction rollers 5'. The lower roller segment frame 18 is also linked to the lower part of the fixed upper frame 25 of a gate shape.

There are provided four oil hydraulic cylinders 4, two at the upstream location and two at the downstream location of the upper roller segment frame 12. Alternatively, two oil hydraulic cylinders may be provided, one at the center of the upstream side and the other at the center of the downstream side.

The casting direction guide 26 is provided such that it is in parallel with the normal line 42 which connects the center O of the curved segment and the center of the upper roller segment frame (which will be described below with reference to FIG. 14 ). The purpose of the casting direction guide 26 is to provide the upstream guide shaft 19 and downstream guide shaft 20 with a straight sliding movement, or in other words, advancing and retracting movement in the direction normal to the curved portion. Thus, the upper roller segment frame 12 advances and retracts so that the upstream guide shaft 19 moves along the casting direction guide 26 by the hydraulic cylinder 4, and at the same time, the frame 12 advances and retracts in the direction normal to the curved portion.

A cylinder rod 28 of the hydraulic cylinder 4 is attached to the upper roller segment frame 12 by a pin 29 so as to allow a rotary movement of the frame 12. Similarly, the hydraulic cylinder 4 is attached to the fixed upper frame 25 of a gate shape via a metal fitting 30 by a pin 29 structure.

Indicated by 27 is the center of rotation of the upper roller segment frame 12 at the position where the thickness of a slab with a liquid core 1*a* is reduced by lowering the upper roller segment frame 12 to press the upstream guide shaft 19 against the lower limit stopper 21. The rotation is stopped by the lower rotation limit stopper 23 which controls the rotation of a downstream guide shaft.

As shown in FIG. 11, the position of casting by the reduction rollers 5 and 5' on the farthest side is located so that it is always on the upstream side of the center 27 of rotation of the upstream guide shaft 19. With this arrangement, the coming up 41 shown in FIGS. 2 and 3 can be avoided.

If there are a plurality of reduction roller blocks, upper roller segment frames 12 are not connected to each other (see reduction blocks 6*a,* 6*b,* and 6*c* in FIG. 9). With the reduction blocks shown in FIGS. 11 and 12, reduction is performed in the following manner. First, from the start of casting to the start of reduction, the upper roller segment frame 12 is elevated so that the reduction roller pairs 5 and 5' are aligned along the passline 39 before reduction. The position is controlled by adjusting the position at which the upper guide shaft 19 and lower guide shaft 20 hit their upper limit stoppers 22.

After reduction is started, the upper roller segment frame 12 is moved downward so that the upper reduction rollers 5 are aligned along the passline 40 during reduction. The upstream guide shaft 19 hits the lower limit stopper 21, and at this position, the downstream guide shaft 20 of the upper roller segment frame 12 is rotated about the center 27 of rotation until it hits the lower rotation limit stopper 23 which controls the rotation of a downstream guide shaft.

The upper reduction rollers 5 are placed so that they are opposed to lower reduction rollers 5' when they are aligned along the pre-reduction passline 39 or post-reduction passline 40.

During reduction, the hydraulic cylinders 4 receive a force greater than the resisting force of reduction plus bulging force in which varying factors are also considered. As a result, a predetermined reduction passline can be maintained and a consistent thickness of the resulting products can be obtained.

Briefly, the upper roller segment frame 12 having a plurality of upper reduction rollers 5 are moved downward by the hydraulic cylinders 4. Simultaneously, the upper roller segment frame 12 is permitted to move not only straightly in the normal direction as described above but also to rotate by the upstream guide shaft 19 and the downstream guide shaft 20 along with the lower limit stopper 21 and the lower rotation limit stopper 23 which controls the rotation of a downstream guide shaft. As a result, upper reduction rollers 5 can be advanced or moved downward so as to be aligned along the slab passline during reduction. On the other hand, when the upper segment frame 12 is moved upward, the position of the guide shafts 19 and 20 is defined by the upper stopper 22 fixed to the fixed upper frame 25 to allow the upper reduction rollers 5 to be moved up so as to be aligned along the slab passline before reduction at the time of casting.

By this method, it is possible to cope with changes of slab thickness from the start of casting to reduction. That is, by defining the passline during reduction 40 using guide shafts 19 and 20 and stoppers 21, 22, and 23, even when excessive reduction force is applied, the slab with liquid core 1*a* and reduction rollers 5 and 5' are free from such an excessive force. In addition, control of reduction force is not necessary. The passline during reduction can be determined only by applying a force greater than the total of resisting force of reduction plus force of bulging. Even when the slab temperature and the thickness of a solidified shell are altered to change the resisting force of reduction, the reduction passline can be maintained.

The deviation presented when the two slab passlines are superposed, one during reduction and the other before reduction, or in other words, during casting, is described with reference to FIG. 13. Then, the reason why it is necessary to provide a mechanism that is capable of moving the upper roller segment straight but also rotating it is described with reference to FIG. 14.

Figure 13:
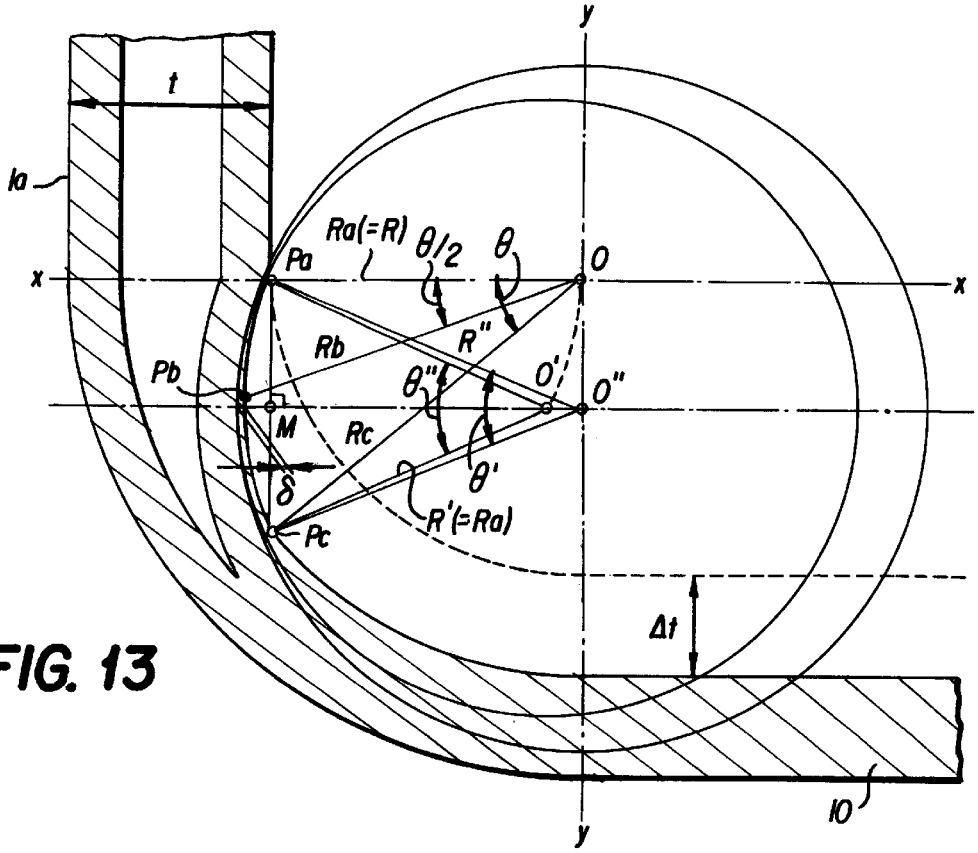
FIG. 13 is a schematic longitudinal sectional view for explaining reduction of a slab with liquid core.

FIG. 13 is a schematic longitudinal sectional view for explaining reduction of a slab with liquid core. In FIG. 13, the whole reduction zone, seen from the center O of the circle (radius=R) on the curved segment of the continuous caster, is represented by θ, the amount of reduction is Δt, and the reduction speed is constant.

A circle that passes three points on the passline of a slab with liquid core 1*a* during reduction (start point Pa, middle point Pb, and the terminal point Pc) is determined univocally. The radius and the center of this circle are represented by R" and O", respectively. A circle having a radius R' (=Ra; a slab passline before reduction) is superposed so that it passes through points Pa and Pc. The center O' of this circle is located on a straight line connecting the middle point M of Pa and Pc and O". Accordingly, the distance between the middle points of the two circular arcs that pass Pa and Pc is the maximum value δ of the deviation between the two passlines.

In this connection, the superposing operation of the passlines in FIG. 13 is identical to a rotary movement of the point O with respect to Pa onto a straight line connecting the points M and O".

In an actual apparatus, the point Pa is a point of contact between a reduction roller 5 and a slab with liquid core 1*a*. Therefore, rotary movement of the center O of the curved segment about the point Pa onto the center O' of a circle having a radius R that passes Pa and Pc, as shown in FIG. 13, must be performed while the farthest side roller of the upper reduction rollers 5 is guided so as to serve as a center of rotation. However, this is not realized in actual apparatuses, because arrangement of upper limit and lower limit stoppers 22, 21 and a casting direction guide 26 is difficult. Thus, in actual apparatuses, guide shafts 19 and 20 must be placed at positions remote from upper reduction rollers 5.

In order to move the point O to O', it is necessary that the upstream guide shaft 19 itself that serves as the center of rotation move straightly in the direction normal to the curved portion to control the maximum value δ of the deviation shown in FIG. 13. In view of this, the upstream guide shaft 19 was allowed to move straightly in the direction normal to the curved portion to achieve a displacement of the point O to point O'.

Figure 14:
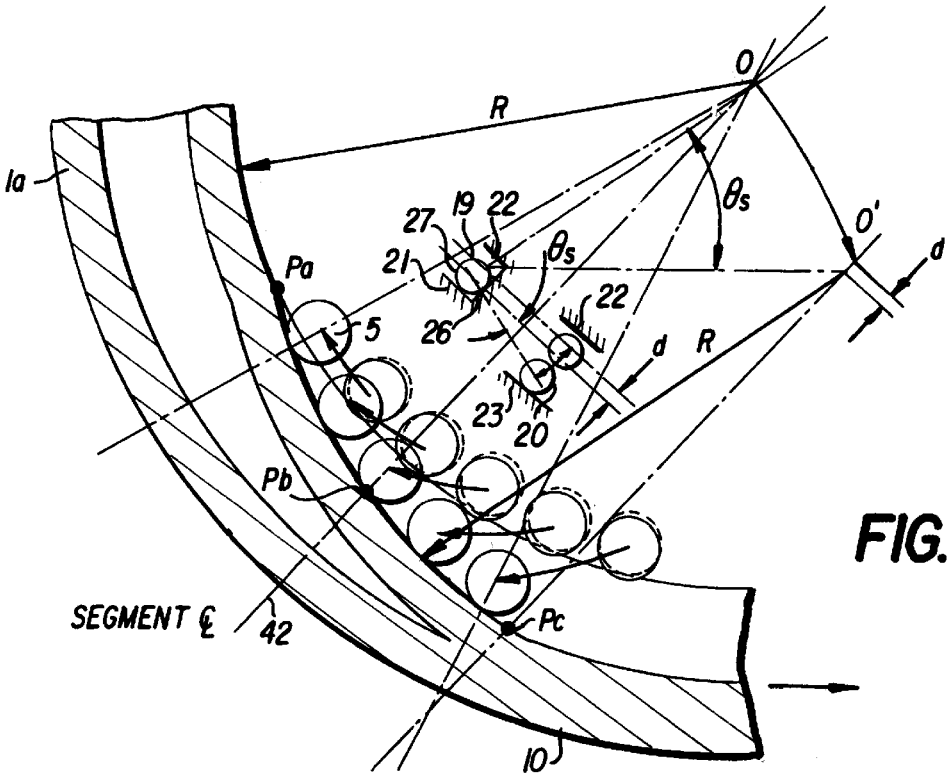
FIG. 14 is a schematic longitudinal sectional view for explaining reduction of a slab with liquid core in the case where guide shafts of an upper roller segment frame are placed on the upstream and downstream sides above upper reduction roller groups, and the direction of a casting direction guide is parallel to the direction normal to the curved portion.

With reference to FIG. 14, the above-mentioned displacement of the center of a curved segment will next be described from the geometric point of view.

FIG. 14 is a schematic longitudinal sectional view for explaining reduction of a slab with liquid core in the case where guide shafts 19 and 20 of an upper roller segment frame 12 are placed on the upstream and downstream sides, respectively, above upper reduction rollers 5, and the direction of a casting direction guide 26 is aligned in parallel to the direction 42 normal to the curved portion.

The amounts of the straight movement and angle of rotation of the upper roller segment frame 12 will be found so as to displace the center O of the curved portion to the point O' with respect to the upper positions of guide shafts 19 and 20, i.e., their positions before reduction. When the center O of the curved portion is rotated about the upstream guide shaft 19, the angle of rotation made before a line in parallel to the center line of the upper roller segment frame 12 and passing through the point O' is crossed is represented by θs, and the distance between the intersection and the point O' is represented by d. The distance d and the angle of rotation θs are the amounts of the straight movement in the direction normal to the curved portion and the angle of rotation of the upper roller segment frame 12.

These two factors are determined by the location of the lower limit stopper 21 of the upstream guide shaft 19 and the lower rotation limit stopper 23 which controls rotation of the downstream guide shaft 20.

Next, the second apparatus of the present invention is described with reference to FIGS. 15 and 16.

In this apparatus, the lower limit stopper 21 and the lower rotation limit stopper 23 which controls rotation are made movable using a mechanism such as a worm jack and an electric control apparatus. Thus, using the reduction block of the invention, it is possible to adjust the upper roller segment frame 12 for the amount of direct movement in the direction normal to the curved portion as well as the angle of rotation in conformity with changes in the amount of reduction and in the reduction pattern during operation without stopping the apparatus. The reduction block of the invention is also adapted to changes in thickness of the slab product by the exchange of molds. This can also be done without stopping the apparatus by making the position of the upper limit stoppers 22 variable.

Figure 15:
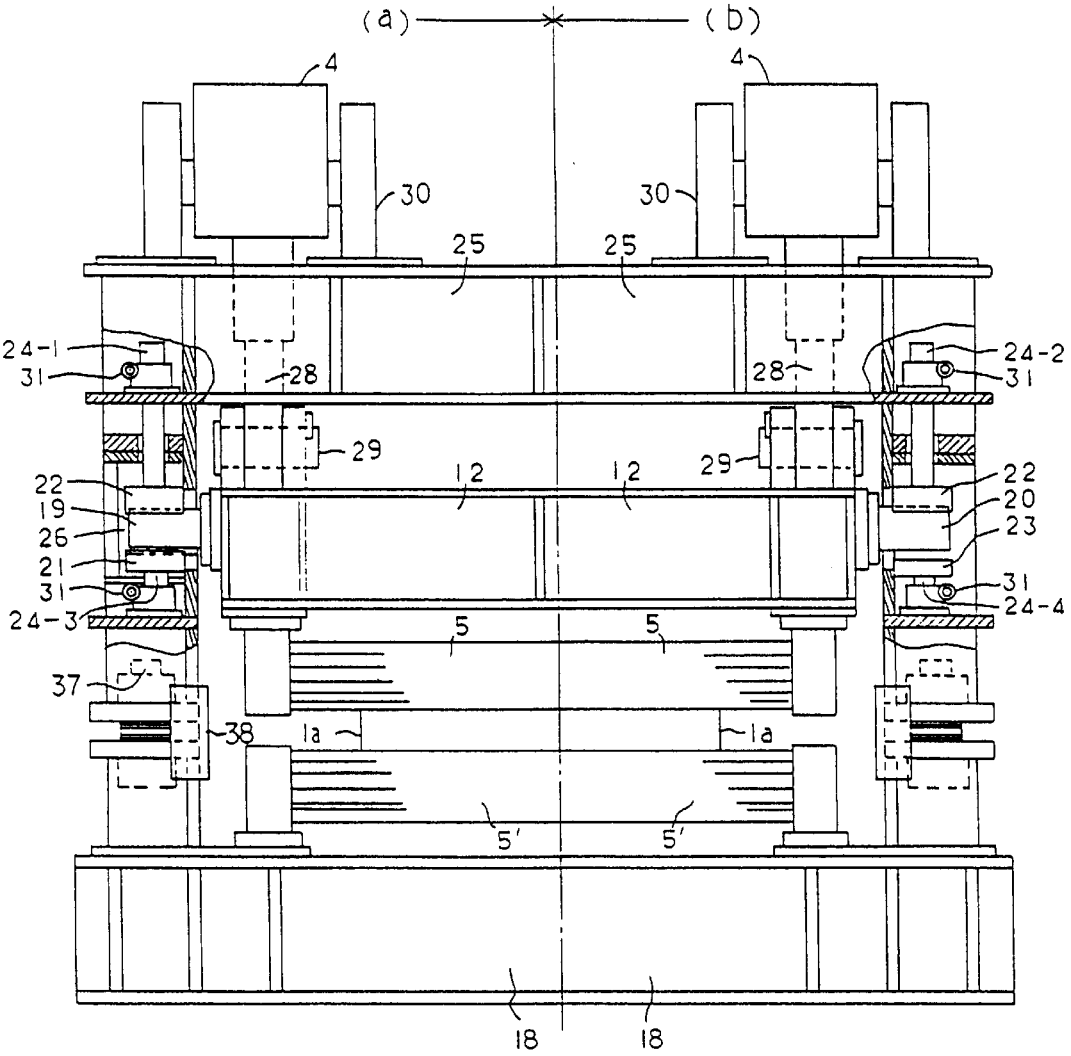
FIG. 15(*a*) is a schematic partial view of a longitudinal section showing the upstream front view of a reduction roller block used in the second apparatus of the present invention, and FIG. 15(*b*) is a schematic partial longitudinal sectional view showing the downstream front view of a reduction roller block used in the second apparatus of the present invention.

FIG. 15(*a*) is a schematic partial view of a longitudinal section showing the upstream front view of a reduction roller block used in the above apparatus of the present invention, and FIG. 15(*b*) is a schematic partial view of a longitudinal section showing the downstream front view of a reduction roller block used in the above apparatus of the present invention.

In FIG. 15(*a*) showing the upstream side, a reduction block is provided with at least one upper roller segment frame 12 for raising and lowering upper reduction rollers 5, a plurality of upper reduction rollers 5 provided beneath the upper roller segment frame 12, an upstream guide shaft 19 which are fixed to the frame 12, a moving device for moving the frame 12 up and down, e.g., a hydraulic cylinder 4, a fixed upper frame 25 of a gate shape for accommodating the moving device, a lower limit stopper 21 and an upper limit stopper 22 for defining the stop positions of the guide shaft 19, and a casting direction guide 26 for the guide shaft 19. Thus, the essential structure of the apparatus is the same as that in FIG. 11.

In FIG. 15, the upstream guide shaft 19, the lower limit stopper 21, the upper limit stopper 22, and the casting direction guide 26 are not directly connected to the fixed upper frame 25 of a gate shape. In this apparatus, worm jacks 24-1, 24-3 and worm 31 are provided for altering the thickness of a slab with liquid core 1*a* or the amount of reduction to adjust or determine the amount of vertical displacement of the upper limit stopper 22, lower limit stopper 21, and the casting direction guide 26 are thereby not directly connected to the fixed upper frame 25 of a gate shape.

In FIG. 15(*b*) showing the downstream side, there are provided a downstream guide shaft 20, an upper limit stopper 22 and a lower rotation limit stopper 23 which controls rotation. It is however not provided with a casting direction guide 26. Similar to the upstream side, using worm jacks 24-2, 24-4 and worm 31 which are provided for altering the thickness of a slab with liquid core or the amount of reduction, amounts of vertical displacement of the upper limit stopper 22 and the lower rotation limit stopper 23 which controls rotation are adjusted or controlled.

In both upstream and downstream sides, the hydraulic cylinders 4 and metal fittings 30 are disposed so that the hydraulic cylinders 4 are rotatable in the casting direction. As in the apparatus shown in FIG. 11, 28 is a cylinder rod and 29 is a pin.

In addition to the above, there is provided a lower roller segment frame 18 for supporting the lower reduction rollers 5'. This lower roller segment frame 18 is supported by and connected to the lower part of the fixed upper frame 25 of a gate shape. In the case of FIGS. 15(*a*) and 15(*b*), bolts 37 are used along with displacement preventing guides 38 provided for the fixed upper frame 25 and the lower segment frame 18 to achieve the connection. However, they may be integrally formed.

Figure 16:
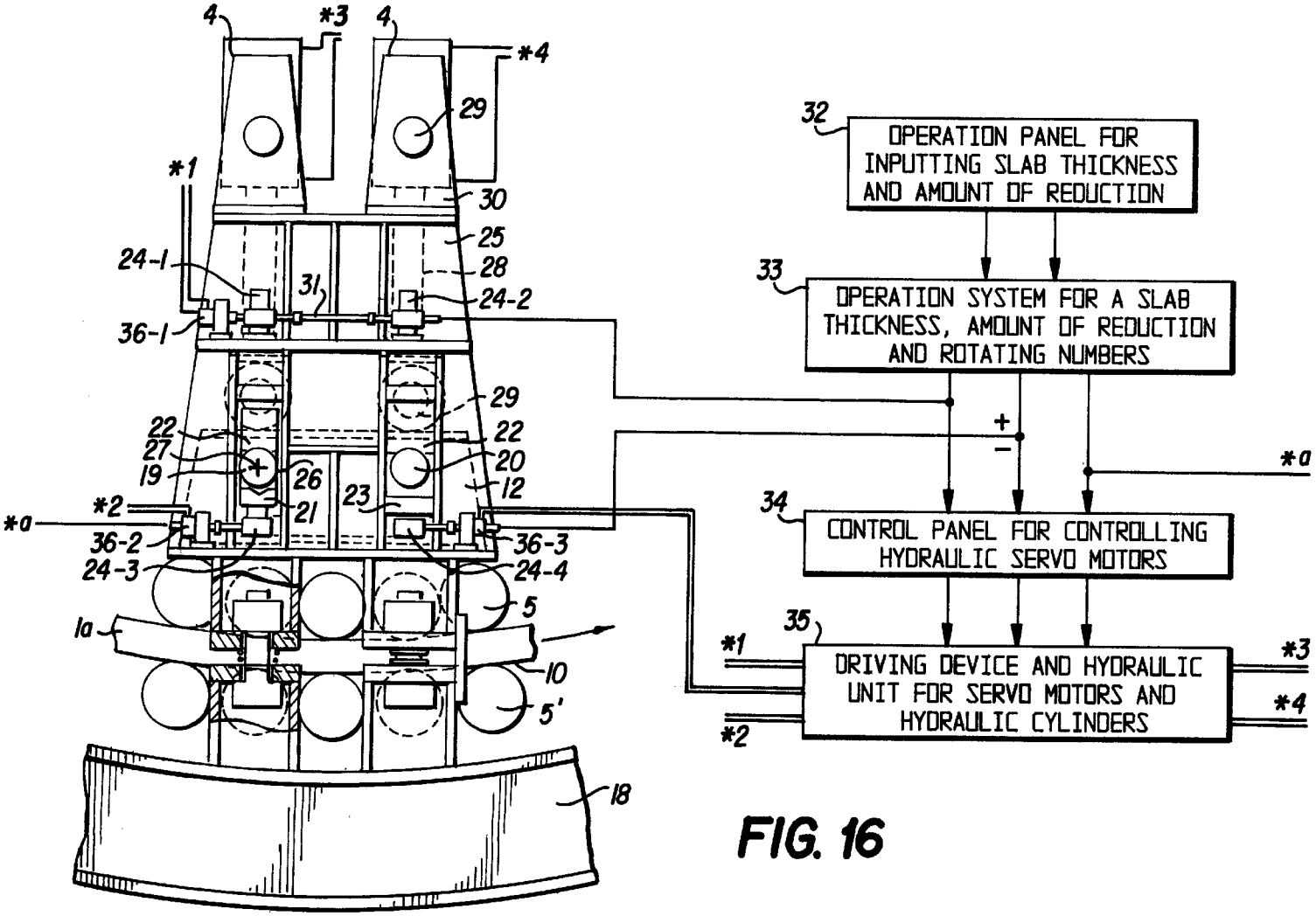
FIG. 16 is a partial longitudinal sectional view showing the side view of a reduction roller block used in the second apparatus of the present invention along with the structure of a control system.

FIG. 16 is a partial longitudinal sectional view showing the side view of a reduction roller block used in the above apparatus along with the structure of a control system. As shown in FIG. 16, the worm jacks 24-1 and 24-2 for changing the thickness of a slab are driven by a worm and a hydraulic servo motor 36-1 with a rotation detector and revolving the worm 31. The worm jacks 24-3 and 24-4 for changing the amount of reduction are independently driven by hydraulic servo motors 36-2 and 36-3 each having a rotation detector.

The electric control device for performing reduction includes an operation panel 32 for inputting a slab thickness and amounts of reduction, an operation system 33 which performs calculation for a slab thickness and amounts of reduction by use of motor speed, a control panel 34 for controlling the hydraulic servo motor, a driving device 35 for the hydraulic servo motor, a hydraulic servo motor 36-1 with a rotation detector for driving the worm jacks 24-1 and 24-2 for changing the thickness of a slab, and hydraulic servo motors 36-2 and 36-3 each having a rotation detector for driving the worm jacks 24-3 and 24-4 for changing the thickness of a slab.

Each of the above servo motors has a reduction gear. The hydraulic servo motor driving device 35 is a servo hydraulic device. It is also used for driving the hydraulic cylinder 4.

When the amount of reduction is desired to be changed, the hydraulic servo motors 36-2 and 36-3 are actuated as follows. First, on the operation panel 32, a desired amount of or revised amount of reduction is input. The input data are calculated into a motor speed corresponding to the amount of reduction using the operation system 33, and thus a signal which serves as an output command is output to the control panel 34 for controlling the hydraulic servo motor. The control panel 34 is connected to the hydraulic servo motor driving device 35 to actuate it.

The speeds of rotation of the hydraulic servo motors 36-2 and 36-3 are reduced by reduction gears to move up and down the worm jacks 24-3 and 24-4 for changing the amount of reduction. Subsequently, the rotation of the above-mentioned motors is stopped at the position corresponding to the predetermined amount of reduction which has been changed. At this time, whether the speed of the respective motors is proper is determined by feeding back the speed values with rotation detectors, each being directly connected its counterpart motor, and comparing with the command value. The difference between the preset value of the amount of reduction which has been input and the amount of reduction performed (actual amount of reduction at the worm jacks) is compensated.

When the slab thickness is to be changed, a thickness change is selected at the operation panel 32, and the predetermined thickness value is input. The procedure for changing the thickness is the same as that for changing the amount of reduction except that the subjects to be driven are the worm jacks 24-1 and 24-2 for changing the thickness of a slab, and the hydraulic servo motor 36-1 with a rotation detector.

In either case, it is advantageous from the viewpoint of economy that, in order to reduce the load and capacity of each motor, a detection sensor for detecting the amount of shifting is built-in in each of the hydraulic cylinder 4 to move up or down the upper roller segment frame at the advancing or retracting speed of each worm jack.

By changing the amount of reduction using the above-mentioned reduction block(s) during the operation of reduction, continuous casting of slabs with different thicknesses can be realized.

Figure 2:
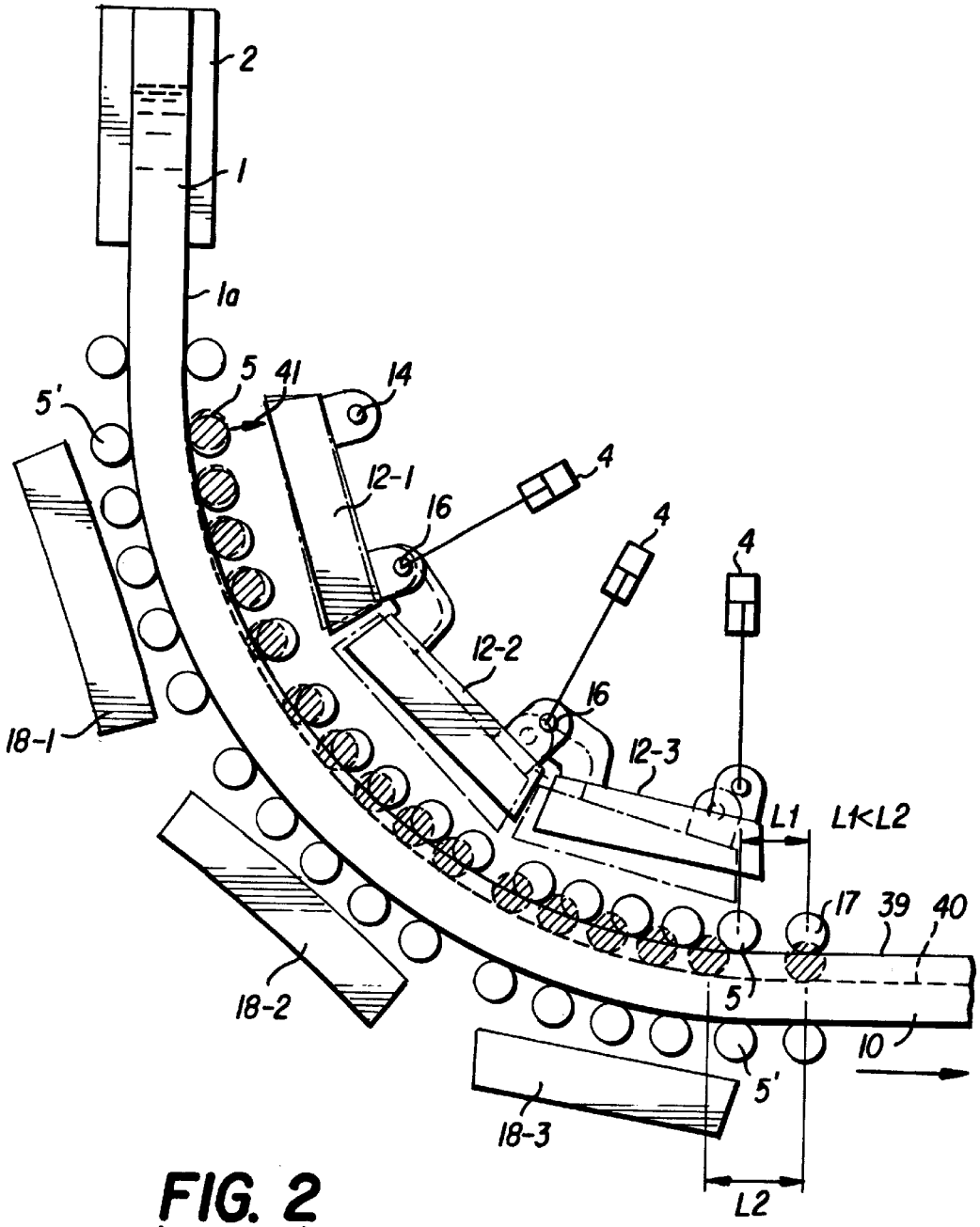
FIG. 2 (PRIOR ART)
FIG. 2 is a schematic longitudinal sectional view taken along the passline of a conventional reduction apparatus employing connected segment frames, and illustrates the situation where gaps of rollers are produced.
Figure 3:
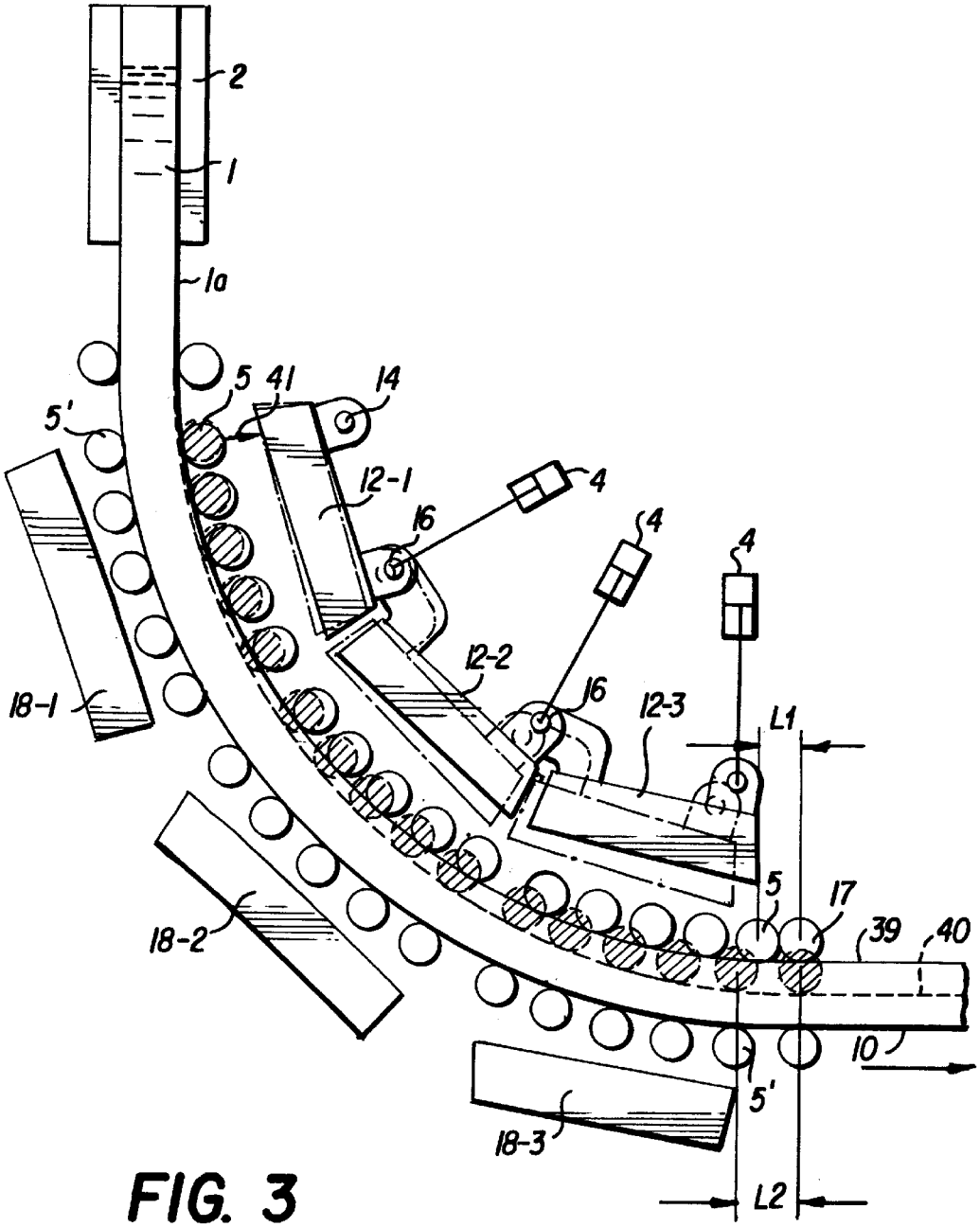
FIG. 3 (PRIOR ART)
FIG. 3 is a schematic longitudinal sectional view taken along the passline of a conventional reduction apparatus employing connected segment frames, and illustrates another situation where the gaps of rollers are produced.
Figure 17:
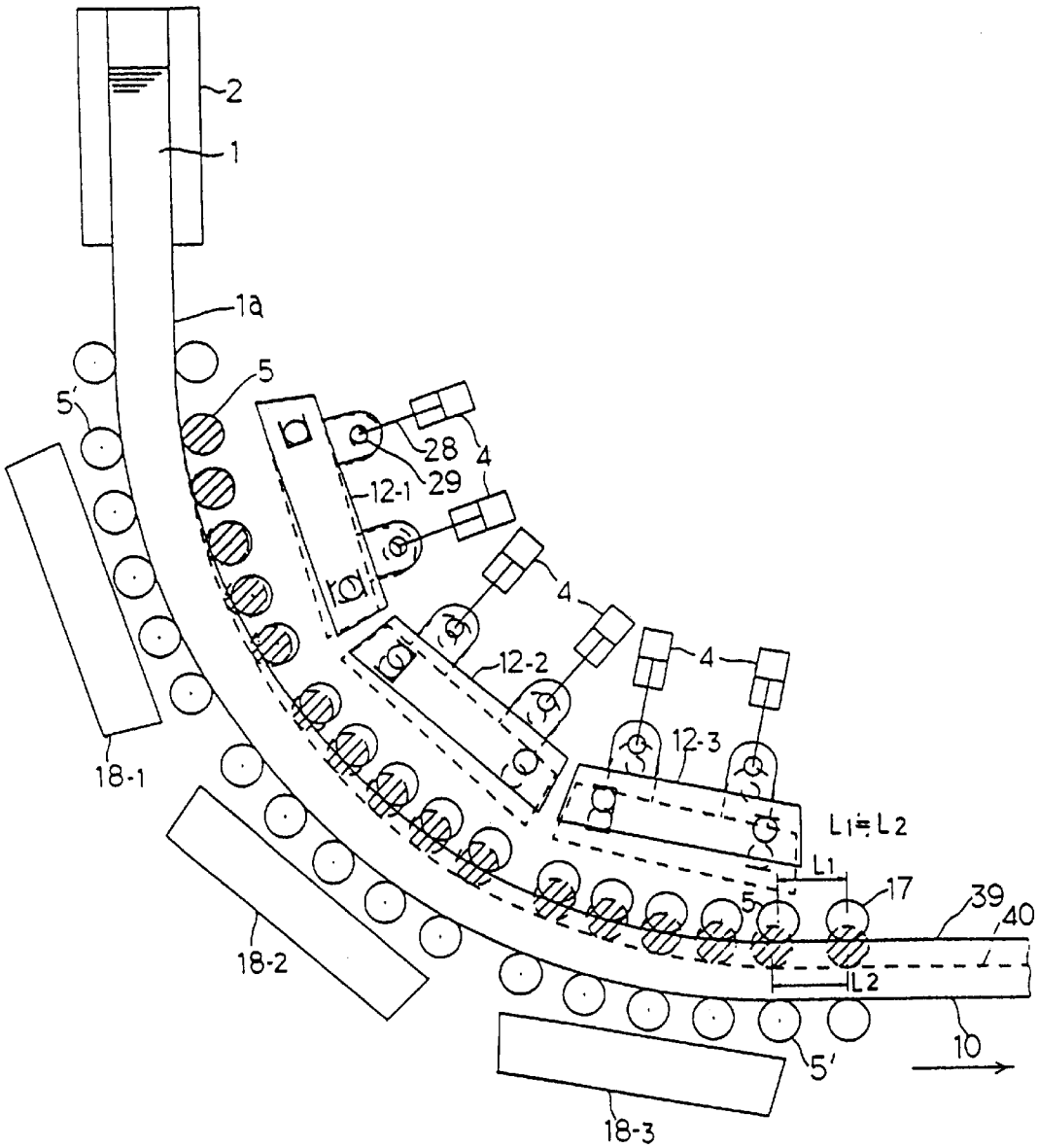
FIG. 17 is a drawing showing the situation where use of the first and second apparatuses of the present invention improved the interval between the reduction roller placed at the leading end of the final reduction roller block and the roller placed downstream and adjacent to this roller.

FIG. 17 is a drawing showing the situation where use of the first and second apparatuses of the present invention improves the interval between the reduction roller placed at the leading end of the final reduction roller block and the roller placed downstream and adjacent to this roller, which is the problem encountered by conventional reduction blocks indicated and shown in FIGS. 2 and 3. By adopting a method for bringing those two passlines to coincide, misalignment strains can be mitigated which are applied when a slab with liquid core is subjected to a thickness reduction.

Various effects obtained by use of the methods and apparatuses of the present invention are described in the following example section which contains Tests 1 to 5.

Test 1

A steel species having the composition shown in FIG. 18 was used (superheat of a molten steel in a tundish: 30° C.). The apparatus employed was a curved type continuous caster shown in FIG. 4. The casting conditions for making a thin slab were as follows:

Mold size on the inside: 1,000 mm in long side width×100 mm in short side width

Support rollers: diameter; 110–190 mm, roller pitch; 150–300 mm

Location of the reduction zone: between 2,800 and 6,000 mm from the meniscus of the molten steel in the mold Number of reduction roller pairs: 15

Pitch of reduction rollers: 185–227 mm

Specific water ratio of secondary cooling: 4 liters/(kg-steel)

The reduction conditions are shown in FIG. 19.

In all cases, the total amount of reduction was 30 mm so that a the thickness of a 100 mm-thick slab is reduced to 70 mm (total reduction: 30%).

The casting speed was 4.0 m/min so that the final solidification point after reduction is located on the downstream side of the final reduction roller throughout the cases.

As shown in FIG. 19, in Example 1 of the present invention which corresponds to the first method of the invention, the length of the strain accumulative region was taken into account. Thus, a great amount of reduction was applied to the farthest upstream side reduction roller (roller No. 1). The amount of reduction was gradually diminished on the downstream side. Similarly, in Example 2 of the present invention, the same amount of reduction was applied to the two adjacent reduction rollers (reduction roller Nos. 6 and 7). On the other hand, in Comparative Example 1, the same amount of reduction was applied to respective reduction rollers without accounting the length of the strain accumulative region. In Comparative Example 2, conversely to the Example 1 of the present invention, a small amount of reduction was applied to the farthest upstream side reduction roller (roller No.1), and the amount was gradually increased in the downstream direction. The results are shown in FIG. 20.

Figure 20:
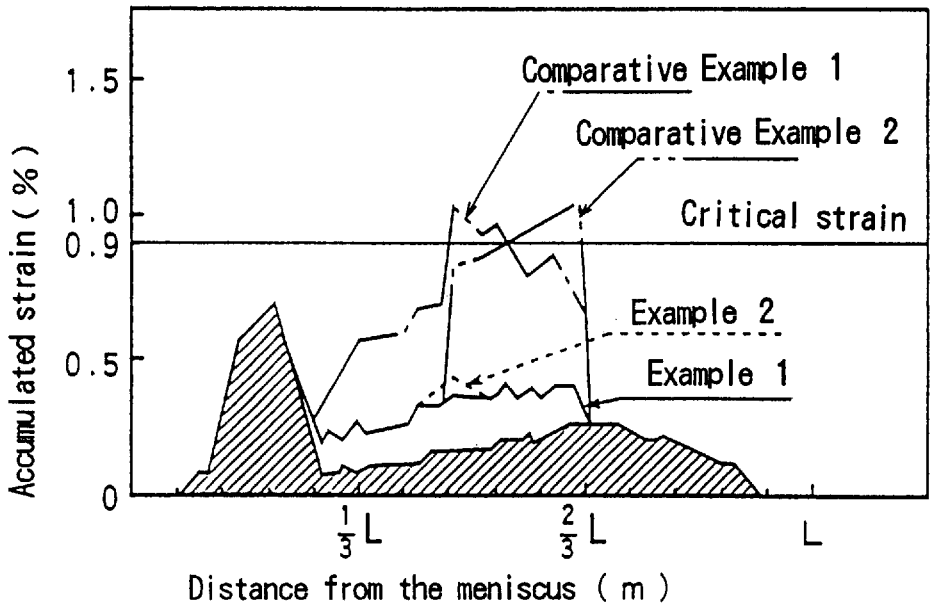
FIG. 20 is a chart showing the relationship among total accumulated strain, the distance from the meniscus, and the critical strain in Test 1.

FIG. 20 is a chart showing the relationship among total accumulated strain, the distance from the meniscus, and the critical strain in Test 1. The hatched area indicates the accumulated strain of internal strains shown in FIG. 7 other than the strain caused by reduction of liquid core. As shown in FIG. 20, the strains caused by reduction of a strand with liquid core in Examples 1 and 2 of the present invention are almost uniform in the region affected by accumulated strains and are generally small. By contrast, in Comparative Example 1, the strain accumulative region in which a maximum strain caused by reduction of a strand with liquid core generates was long, permitting great amounts of the strain to be accumulated. In Comparative Example 1, it is clear that a great amount of total accumulated strain surpassing the critical value was generated. From the same reason, in Comparative Example 2, a great amount of total accumulated strain was generated and the critical value was surpassed.

When sections of the thus-obtained slab pieces were sulfur-printed, no internal cracks were observed in thin slab samples of Examples 1 and 2 of the present invention. In the slab samples of Comparative Example 1 and 2, generation of internal cracks was confirmed. Evaluation results are also shown in FIG. 19. Symbol A indicates that no internal cracks were generated, and C indicates that internal cracks were generated.

The relationship between the difference in reduction incline of two adjacent rollers and the carbon content of steels was further investigated. As a result, it was found that generation of internal cracks in a thin slab can be prevented by reducing the difference in reduction incline not more than 2% in the case where a steel species having the composition and critical strain shown in FIG. 18 is processed, and not more than 5% in the case where low carbon steels and ultra low carbon steels are processed which have even higher critical strains.

Test 2

A steel species having the composition shown in FIG. 18 was used ( superheat of a molten steel in a tundish: 30° C.). The apparatus employed was a curved type continuous caster shown in FIG. 9. The casting conditions for making a thin slab were as follows:

- Mold size on the inside: 1,000 mm in long side width×100 mm in short side width
- Support rollers: diameter; 110–190 mm, roller pitch; 150–300 mm
- Location of the reduction zone: between 2,800 and 6,000 mm from the meniscus of the molten steel in the mold
- Number of reduction roller pairs: 3
- Number of hydraulic cylinders: Four for each reduction roller block (2 on the upstream side, and 2 on the downstream side)
- Number of pairs of reduction rollers in one reduction roller block: 5
- Pitch of reduction rollers: 185–227 mm
- Specific water ratio of secondary cooling: 4 liters/ (kg-steel)
- The slab thickness, total amount of reduction (% total reduction) and the casting speed: same as Test 1

The reduction conditions are shown in FIG. 21.

As shown in FIG. 21, in Example 3 of the present invention which corresponds to the second method of the invention, a greater amount of reduction was applied to upper reduction roller blocks. Moreover, the difference in reduction incline between two reduction roller blocks or that between the final reduction block and its downstream unbending zone was made small. In Example 4 of the present invention, the same amount of reduction was applied to the rollers of the adjacent second and third reduction roller blocks. In Example 5 of the present invention, only the mean reduction incline between the first and the second reduction roller blocks was made greater than that for other roller blocks. On the other hand, in Comparative Example 3, the same amount of reduction was applied to the reduction rollers in respective reduction roller blocks. The results are shown in FIG. 22.

Figure 22:
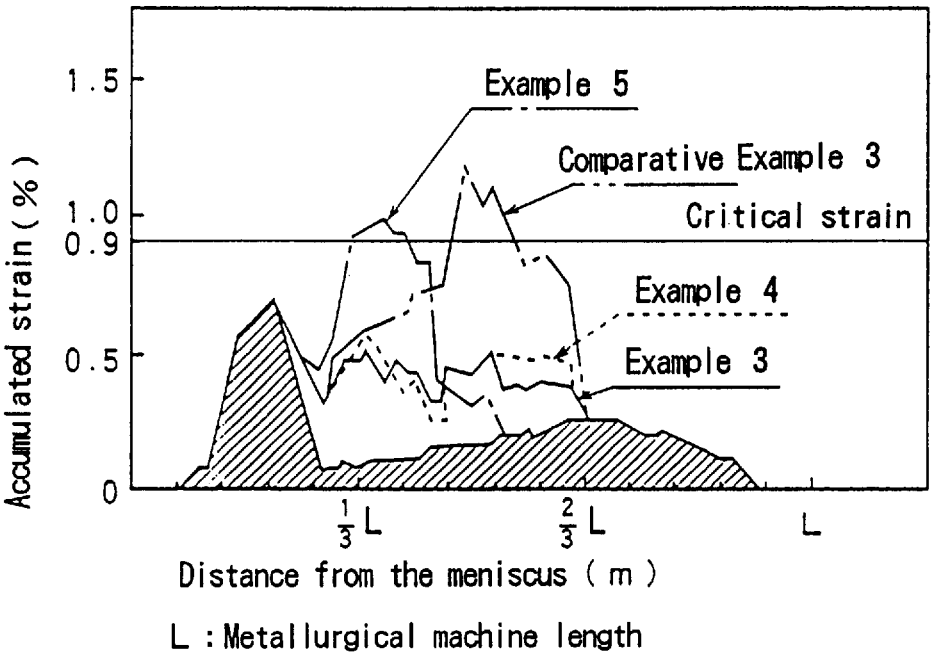
FIG. 22 is a chart showing the relationship among total accumulated strain, the distance from the meniscus, and the critical strain in Test 2.
Figure 26A:
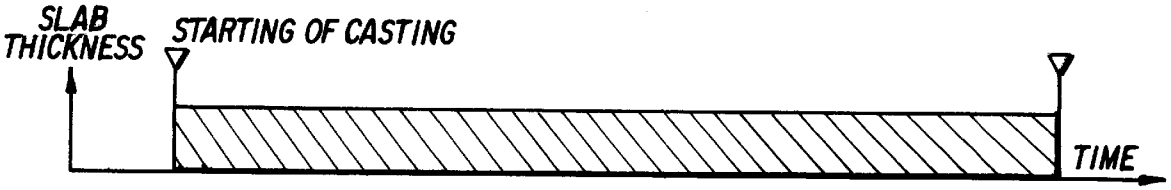
FIG. 26(*a*) to FIG. 26(*d*) are charts showing a variety of continuous casting methods which can be performed by the apparatuses of the present invention.
Figure 26B:
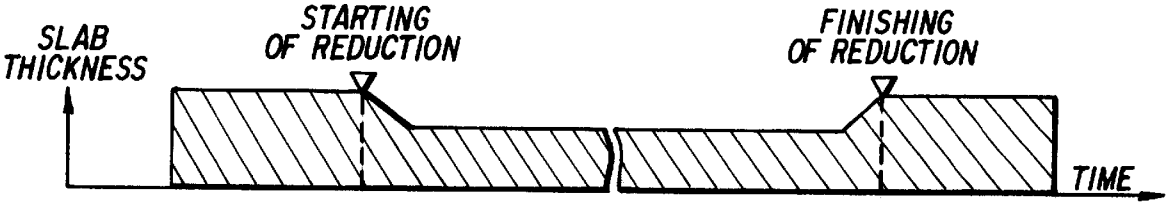
Figure 26C:
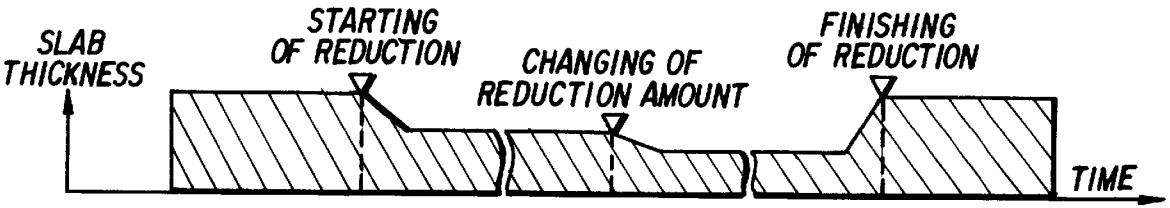
Figure 26D:
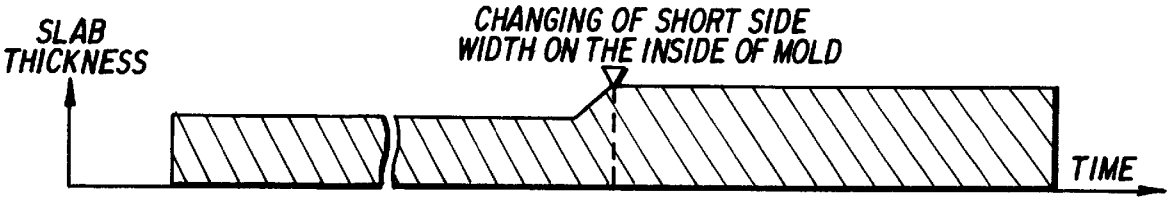

FIG. 22 is a chart showing the relationship among total accumulated strain, the distance from the meniscus, and the critical strain. The hatched area indicates the accumulated strain of internal strains shown in FIG. 7 other than the strain caused by reduction of liquid core. As shown in FIG. 22, the strains caused by reduction of a strand with liquid core in Examples 3 and 4 of the present invention are almost uniform in the region affected by accumulated strains and are generally small. In Example 5 of the present invention, the slab was bent due to a great amount of the difference in mean reduction incline to invite influences by strain caused by reduction of a strand with liquid core. The maximum value of total accumulated strain slightly surpassed the critical value. By contrast, in Comparative Example 3, the strain accumulative region in which a maximum strain caused by reduction of a strand with liquid core generates was long, permitting great amounts of the strain to be accumulated.

When sections of the thus-obtained slab pieces were sulfur-printed, no internal cracks were observed in thin slab samples of Examples 3 and 4 of the present invention. In the slab sample of Example 5 of the present invention, small amounts of internal cracks were observed. In Comparative Example 3, generation of internal cracks was confirmed. Evaluation results are also shown in FIG. 21. Symbol A indicates that no internal cracks were generated, B indicates small amounts of internal cracks were generated, and C indicates that considerable amounts of internal cracks were generated.

The relationship between the mean difference in reduction incline of two adjacent rollers and the carbon content of steels was further investigated. As a result, it was found that generation of internal cracks in a thin slab can be prevented by reducing the mean difference in reduction incline not more than 2% in the case where a steel species having the composition and critical strain shown in FIG. 18 is processed, and not more than 5% in the case where low carbon steels and ultra low carbon steels are processed which have even higher critical strains.

Test 3

A steel species having the composition shown in FIG. 18 was used (superheat of a molten steel in a tundish: 30° C.). The apparatus employed was a curved type continuous caster shown in FIG. 4. The reduction rollers were disposed inside a circular arc having a certain radius of curvature (R=3.5 m). Reduction was started from the bending zone. The casting conditions for making a thin slab excepting reduction conditions and the % total reduction ratio were the same as those in Test 1. The reduction conditions are shown in FIG. 23.

The Examples 6 and 8 of the present invention shown in FIG. 23 were performed under the same conditions as those in the Examples 1 and 3, respectively. The Examples 7 and 9 of the present invention employed a reduction pattern similar to that as employed in the Examples 1 and 3, respectively. In these examples, reduction was started from the bending zone. The results are shown in FIG. 24.

FIG. 24 is a chart showing the relationship among total accumulated strain, the distance from the meniscus, and the critical strain. The hatched area indicates the accumulated strain of internal strains shown in FIG. 7 other than the strain caused by reduction of liquid core. As shown in FIG. 24, the strains caused by reduction of a strand with liquid core in Examples 6 and 8 of the present invention were added such that it evaded the strain accumulative region in which a maximum accumulated strain was present prior to reduction. Moreover, the maximum accumulated strain prior to reduction was not surpassed even in the portion where strain peculiar to reduction of a strand with liquid core was added. In Examples 7 and 9 of the present invention, the rollers at which reduction started was inside the bending zone. Therefore, strain caused by reduction of a strand with liquid core is added to the portion with accumulated bending strain where a maximum accumulated strain was present prior to reduction, increasing the maximum accumulated strain. However, in Examples 7 and 9 of the present invention, since a reduction pattern similar to that in Examples 1 and 3 of the present invention was adopted, the critical strain was not surpassed by a maximum accumulated strain.

When sections of the thus-obtained slab pieces were sulfur-printed, no internal cracks were observed in thin slab samples of Examples 6 and 8 of the present invention. In the slab samples of Examples 7 and 9 of the present invention, a slight amount of very small internal cracks that would not affect the product quality were observed. This is because, although the bending strain and the accumulated strain caused by reduction of a strand with liquid core were not more than the critical strain, the critical strain was slightly surpassed due to the addition of a small amount of misalignment strain which is unavoidable and which is difficult to be quantitatively determined. Evaluation results are also shown in FIG. 23. Symbol A indicates that no internal cracks were generated, A' indicates small amounts of very fine internal cracks that would not affect the product quality were generated.

Test 4

The speed of casting, the arrangement of secondary cooling sprays, and the steel species were the same as those in Example 1 and 3 of the present invention in Test 1. Slab of Comparative Examples 4, 5, 6, and 7 were cast under the conditions described below.

In Comparative Example 4, the reduction rollers or reduction roller blocks employed, roller pitch, and the amount of reduction were the modification of Example 1. That is, the roller No. 15 in Example 1 was omitted (therefore, the number of pairs of reduction rollers was 14). The distance from roller No. 11 to roller No. 14 was the same as that from the roller No. 11 to roller No. 15 in Example 1. The roller pitch was constant and was 276 mm. The amounts of reduction performed by the pairs of rollers were the same as those performed by the Nos. 11 to 15 reduction rollers in Example 1 of the present invention. The total amount of reduction was smaller than that in Example 1 by the amount performed by the No. 15 reduction roller, i.e., by 0.11 mm.

Similarly, in Comparative Example 5, the No. 15 roller of the third reduction roller block in Example 3 of the present invention was omitted (therefore, the number of pairs of reduction rollers in the third reduction roller block was 4). The distance from roller No. 11 to roller No. 14 in the third reduction roller block was the same as that in Example 3. The roller pitch was constant and was 276 mm. The amount of reduction performed by each pair of rollers was 1.25 mm. The conditions for the first to the second reduction roller blocks, the total amount of reduction, and the mean reduction incline of the third reduction roller block were the same as those in Example 3 of the present invention.

Similarly, in Comparative Examples 6 and 7, the conditions were the same as those in Examples 1 and 3, respectively.

The specific water ratio (liter/(kg-steel)) of secondary cooling was 3.8 in Comparative Examples 4 and 5, 1.2 in Comparative Example 6, and 1.1 in Comparative Example 7.

In Comparative Examples 4 and 5, many internal cracks which were long and large were found to be generated inside a slab after being cast. In Comparative Examples 6 and 7, very fine internal cracks were generated.

The accumulated strain was calculated. The maximum bulging strains at the position (2/3)-L (L: metallurgical machine length) from the meniscus of a molten steel in the mold were 1.4% in Comparative Examples 4 and 5, and 0.8% in Comparative Examples 6 and 7. The maximum total accumulated strains were 1.6%, 1.7%, 1%, and 1.1%, in Comparative Examples 4, 5, 6, and 7, respectively.

As was predicted from FIG. 20, the above results demonstrated that an increase in the roller pitch and reduction in specific water ratio significantly increased the bulging strain, that a maximum value of the total accumulated strain surpassed the critical value, and that generation of internal cracks cannot be avoided.

Test 5

At the curved portion (radius of curvature R=3.5 m) of a continuous caster, one reduction roller block shown in FIGS. 15 and 16 was built in. A thin slab was made by performing a reduction of a strand with liquid core under the following conditions. Subsequently, a test was carried out to check whether the thickness of a thin slab product and the short side width of a mold could be changed during casting.

Steel species: Steel shown in FIG. 18

Superheat of a molten steel in a tundish: 30° C.

Mold size on the inside: 1,000 mm in long side width×100 mm in short side width

Support rollers: diameter; 110–190 mm, roller pitch; 150–250 mm

Number of pairs of reduction rollers in one reduction roller block: 5

Pitch of reduction rollers: 185–227 mm

Specific water ratio of secondary cooling: 4 liters/(kg-steel)

Speed of casting: 3.5 m/min

Slab thickness: 100 mm (total reduction amount: 25 mm)

Reduction conditions: The amount of reduction per pair of rollers in each reduction block was determined by equally dividing the total amount of reduction (5 mm).

The upper reduction rollers were disposed so that they were directly opposed to the lower reduction rollers on the slab passline during reduction.

FIG. 25 is a chart showing the deviation of the slab passline from that before reduction in the case where the above settings were employed. As is apparent from FIG. 25, the deviation was very small.

FIG. 26(*a*) to FIG. 26(*d*) are charts showing a variety of continuous casting methods which can be performed by the apparatuses of the present invention. FIG. 26(*a*) shows a slab with a uniform thickness made by a conventional casting method, FIG. 26(*b*) shows a slab which has a reduced thickness obtained by reduction of a strand with liquid core (single casting), FIG. 26(*c*) shows the case where the product thickness was altered during casting including reduction of a strand with liquid core, and FIG. 26(*d*) shows the case where the thickness of the mold was changed during the operation of continuous casting.

As described above, in the continuous casting method of the present invention, total accumulated strain can be suppressed by reducing the strain caused by reduction of a strand with liquid core and bulging strain. Therefore, even when reduction is performed on a strand with liquid core under high speed casting conditions, thin slabs with minimized internal cracks can be manufactured.

Moreover, when the continuous caster of the present invention is employed, misalignment strain can be suppressed, and reduction of a strand with liquid core can be performed easily. Also, changes such as in slab thickness can be performed during operation without stopping the apparatus.

What is claimed is:

1. A method of continuous production of a thin slab with reduced strain from a slab drawn from a continuous casting mold with a liquid core, the slab having a liquid phase plus a solid phase after being drawn from the mold, the method comprises the steps of:

rolling the slab having a liquid core between a plurality of pairs of reduction rollers, thereby reducing the thickness of the slab with each pair of reduction rollers;

rolling the slab having a liquid core with the plurality of pairs of reduction rollers at a location between a point directly below the mold from which the slab is continuously drawn, and a point of complete solidification of said slab;

reducing the thickness of the slab having a liquid core with the plurality of pairs of reduction rollers such that the following relationship is satisfied:

$$P_1 \geqq P_2 \geqq P_3 \geqq \text{---} \geqq P_k$$

wherein "P" is the amount of reduction(mm) effected by each pair of reduction rollers, and "k" is the number allotted to each pair of the plurality of pairs of reduction rollers, thereby controlling the amount of reduction in thickness such that the amount of reduction effected by an upstream pair of reduction rollers is greater than or equal to the amount of reduction effected by a pair of downstream reduction rollers, or controlling the amount of reduction such that the amount of reduction effected by all of the pairs of reduction rollers are all equal to each other.

2. A method of continuous production of a thin slab with reduced strain from a slab drawn from a continuous casting mold with a liquid core, the slab having a liquid phase plus a solid phase after being drawn from the mold, the method comprises the steps of:

rolling the slab having a liquid core between a plurality of reduction roller blocks, each reduction roller block having a plurality of pairs of reduction rollers, thereby reducing the thickness of the slab with each pair of reduction rollers;

rolling the slab having a liquid core with the plurality of pairs of reduction rollers at a location between a point directly below the mold from which the slab is continuously drawn, and a point of complete solidification of said slab;

reducing the thickness of the slab having a liquid core with the plurality of pairs of reduction rollers such that the following relationship is satisfied:

$$\text{for a first block: } P_{1,1(1)} = P_{1,2(1)} = P_{1,j-1(1)} = \text{---} = P_{1,j(1)},$$

$$\text{for a second block: } P_{2,1(2)} = P_{2,2(2)} = \text{---} P_{2,j-1(2)} = P_{2,j(2)},$$

$$\cdots$$

$$\text{for an } i\text{-th block: } P_{i,1(i)} = P_{i,2(i)} = \text{---} P_{i,j-1(i)} = P_{i,j(i)},$$

and in addition $$P_{1,1(1)} \geqq P_{2,1(2)} \geqq \text{---} \geqq P_{i,1(i)},$$

wherein "P" is the amount of reduction(mm)effected by each reduction roller pair, "j" is the number allotted to a pair of reduction rollers in a particular block, and "i" is the number of a particular reduction roller block, thereby controlling the amount of reduction in thickness such that the amount of reduction effected by each roller pair within the same block is substantially equal, and the amount of reduction effected by each upstream roller block is greater than or equal to the amount of reduction effected by each downstream roller block, or controlling the amount of reduction such that the amount of reduction effected by all of the roller blocks are all equal to each other; and the mean difference of reduction incline of adjacent roller blocks, expressed as $(R_{(i-1)}-R_i)$, is reduced, wherein:

$$R_i(\%) = \left( \sum_{n=1}^{j(i)} P_{i,n}/La_i \right) \times 100$$

"R" being the reduction incline, "La" is the length of the roller block (mm), "P" is the amount of reduction (mm)effected by each reduction roller pair, "j" is the number allotted to a pair of reduction rollers in a particular block, and "i" is the number of a particular reduction roller block.

3. The method of claim 1 or 2, comprising:

reducing the thickness of the slab having a liquid core with a continuous caster having a curved segment;

reducing the thickness of the slab having a liquid core within a circular arc having a predetermined radius of curvature; and selecting the radius of curvature so as to avoid making bending stain and unbending strain in the slab.

4. The method of claim 1 or 2, comprising minimizing a bulging strain of the slab by providing a slab thickness at the exit of the mold of 70–150 mm, providing a casting speed of 2.5–6 m/min, providing a pitch of slab supporting rollers and reduction rollers of 100–250 mm, and providing a specific water ratio of secondary cooling of 1.5–4.5 liters/kg(steel).

5. The method of claim 3, comprising minimizing a bulging strain of the slab by providing a slab thickness at the exit of the mold of 70–150 mm, providing a casting speed of 2.5–6 m/min, providing a pitch of slab supporting rollers and reduction rollers of 100–250 mm, and providing a specific water ratio of secondary cooling of 1.5–4.5 liters/kg(steel).

6. An apparatus for the continuous production of a thin slab from a slab drawn from a continuous casting mold with a liquid core, the slab having a liquid phase plus a solid phase after being drawn from the mold, the apparatus comprising:

a curved segment;

at least one reduction roller block provided in the curved segment for reducing the thickness of the slab having a liquid core;

an upper roller segment frame for raising and lowering upper reduction rollers;

a plurality of upper reduction rollers provided beneath the upper roller segment frame;

a moving device for moving the upper roller segment frame up and down;

a fixed upper frame of a gate shape for accommodating the moving device;

upstream and downstream guide shafts which are fixed to the upper roller segment frame;

an upper limit stopper for the upstream guide shaft, a lower limit stopper for the upstream guide shaft, a casting direction guide for the upstream guide shaft, each being fixed to the fixed upper frame;

an upper limit stopper for the downstream guide shaft, a lower rotation limit stopper which controls the rotation of a downstream guide shaft, each being fixed to the fixed upper frame;

a lower roller segment frame including a plurality of lower reduction rollers and provided beneath the fixed upper frame of the gate shape; and the upper roller segment frame is connected with the fixed upper frame so that the upper roller segment frame can move in the direction of a normal line that connects the center of the curved segment and the center of the upper roller segment frame simultaneously with movement of the upstream guide shaft and the casting direction guide, and the upper segment frame can rotate about the center of the upstream guide shaft between the upper limit stopper of the downstream guide shaft and the lower rotation limit stopper of the downstream guide shaft, thereby preventing misalignment.

7. The apparatus of claim 6, wherein the reduction block further comprises:

a device for varying the position of each of the upper limit stopper, lower limit stopper, and lower rotation limit stopper; and a control device for controlling the position varying device; whereby the amount of reduction and resulting thickness of the thin slab can be changed without stopping continuous production of the thin slab.

* * * * *